US010828217B2

(12) United States Patent
Ferderber

(10) Patent No.: US 10,828,217 B2
(45) **Date of Patent: *Nov. 10, 2020**

(54) SUPPORT APPARATUS WITH DOUBLE ROLLER ASSEMBLY

(71) Applicant: Frederick Ferderber, Palm Harbor, FL (US)

(72) Inventor: Frederick Ferderber, Palm Harbor, FL (US)

(73) Assignee: Salvus Transportare, LLC, Clearwater, FL (US)

( * ) Notice: Subject to any disclaimer, the term of this patent is extended or adjusted under 35 U.S.C. 154(b) by 500 days.

This patent is subject to a terminal disclaimer.

(21) Appl. No.: 15/493,290

(22) Filed: Apr. 21, 2017

(65) Prior Publication Data

US 2018/0078438 A1 Mar. 22, 2018

Related U.S. Application Data

(63) Continuation of application No. 15/267,796, filed on Sep. 16, 2016, now Pat. No. 9,655,800.

(51) Int. Cl.
*A61G 7/10* (2006.01)
*A61G 1/01* (2006.01)
(Continued)

(52) U.S. Cl.
CPC ..... *A61G 7/1057* (2013.01); *A61G 1/003* (2013.01); *A61G 1/01* (2013.01); *A61G 1/013* (2013.01);
(Continued)

(58) Field of Classification Search
CPC .... A61G 7/1057; A61G 1/003; A61G 7/1059; A61G 7/015; A61G 1/04; A61G 1/013; A61G 1/01; A61G 7/1073
(Continued)

(56) References Cited

U.S. PATENT DOCUMENTS 3,639,926 A * 2/1972 Steelman ..... A61G 1/003 5/628
3,871,036 A * 3/1975 Attenburrow ..... A61G 7/1032 5/81.1 C
(Continued)

FOREIGN PATENT DOCUMENTS

| | | |
|---|---|---|
| CN | 102697616 | 10/2012 |
| WO | 0130295 | 5/2001 |
| WO | 2004039300 | 5/2004 |

OTHER PUBLICATIONS

International Search Report and Written Opinion and Search History dated Nov. 21, 2017 for corresponding PCT International Application No. PCT/US2017/051280.
(Continued)

*Primary Examiner* — Myles A Throop
(74) *Attorney, Agent, or Firm* — Smith & Hopen, P.A.; Paul Murty; Nilay J. Choksi

(57) ABSTRACT

A support apparatus (e.g., stretcher, back board, etc.) with double roller assembly. The apparatus includes a main frame, a first housing containing at least one wheel (e.g., gear, pulley, sprocket, roller) around which a first sheet and/or a second sheet is coiled. The opposite ends of the sheets are coupled to vertically- and horizontally-displaced lead and trail rollers in the double roller assembly, one sheet for each roller. The apparatus further includes a second housing containing at least one wheel around which a chain or belt is disposed. One or both ends of the chain/belt is coupled to the double roller assembly. In operation, a patient is positioned within the main frame, and the sheets extend underneath the patient. The belt/chain mechanism can also help urge extension of the sheets. When the sheets are fully extended underneath the patient, the patient is fully supported and can be transported.

20 Claims, 14 Drawing Sheets

(51) Int. Cl.

| | |
|---|---|
| ***A61G 1/013*** | (2006.01) |
| ***A61G 1/003*** | (2006.01) |
| ***A61G 1/04*** | (2006.01) |
| ***A61G 7/015*** | (2006.01) |

(52) U.S. Cl.
CPC ..... *A61G 1/04* (2013.01); *A61G 7/015* (2013.01); *A61G 7/1059* (2013.01); *A61G 7/1073* (2013.01)

(58) Field of Classification Search
USPC ..... 5/81.1 C
See application file for complete search history.

(56) References Cited

U.S. PATENT DOCUMENTS 4,073,016 A * 2/1978 Koll ..... A61G 7/1032 5/81.1 C
4,669,137 A * 6/1987 Schnelle ..... A61G 7/1019 5/421
4,680,818 A * 7/1987 Ooka ..... A61G 7/103 5/81.1 C
6,698,041 B2 * 3/2004 VanSteenburg ..... A61G 7/103 5/81.1 C
6,971,126 B1 * 12/2005 Kluckhuhn ..... A61G 7/1032 5/81.1 R
7,200,881 B2 * 4/2007 Kasagami ..... A61G 7/1032 5/81.1 C
8,789,219 B2 * 7/2014 Patterson ..... A61G 7/1019 297/330
2001/0047543 A1 12/2001 Vansteenburg et al.
2012/0291196 A1 * 11/2012 Konda ..... A61G 7/1019 5/81.1 C
2014/0143951 A1 5/2014 Patterson et al.

OTHER PUBLICATIONS

International Preliminary Report on Patentability dated Mar. 19, 2019 for corresponding PCT International Application No. PCT/US2017/051280; Applicant: Ferderber, Frederick.

* cited by examiner

SUPPORT APPARATUS WITH DOUBLE ROLLER ASSEMBLY

CROSS-REFERENCE TO RELATED APPLICATIONS

This nonprovisional application is a continuation of and claims priority to U.S. Nonprovisional patent application Ser. No. 15/267,796, entitled "Support Apparatus with Double Roller Assembly", filed Sep. 16, 2016 by the same inventor, the entirety of which is incorporated herein by reference.

BACKGROUND OF THE INVENTION

1. Field of the Invention

This invention relates, generally, to support apparatuses such as stretchers and gurneys. More specifically, it relates to retractable support structure that permits a patient or object to remain substantially stationary prior to transportation on said support structure.

2. Brief Description of the Prior Art

Apparatuses and methods for lifting and transporting objects are well-known in the art. In particular, stretchers and gurneys are examples of such apparatuses for lifting and transporting patients in need of medical care, typically in emergency medical services, military, and search and rescue personnel. The simplest of stretchers basically consist of an elongate tubular frame with a flexible material, such as canvas, disposed therebetween for supporting the weight of the patient thereabove. A significant problem that arises with this type of stretcher is in patient transfer onto the stretcher itself. It can be very difficult to lift a patient and position him/her on the stretcher, for example if the patient is morbidly obese or if any movement would cause further injury to the patient, which can be typical of back injuries. Another method of positioning the patient on the stretcher is by trying to slide a fabric sheet underneath the patient by rolling the patient from side to side and pulling the sheet through, underneath the patient.

Because of these particular patient transfer problems, scoop stretchers were developed, where the stretcher is detachable on each end and separable along a longitudinal axis of the stretcher. Each half can be positioned underneath and on each side of the patient, and then the ends of the stretcher are reattached underneath the patient so that the patient can be lifted with the scoop stretcher. Even using this mechanism, there can be difficulties positioning each half of the stretcher beneath the patient, and particularly with obese patients, there is risk of pinching the patient's back when closing or re-connecting the stretcher, which of course causes pain to the patient.

Another difficulty with conventional stretchers arises when the patient needs to be situated in any position other than completely horizontal, such as in the less-common Trendelenburg position or the more-common Semi-Fowler's position, Fowler's position, and High Fowler's position (i.e., any position where the head should be positioned above the body, even until sitting upright). Folding stretchers can alleviate this difficulty to an extent, but they experience the same issues as the stretchers previously discussed. Those issues may even be further exacerbated, as patient transfer can be very difficult into a more seated or upright position.

It can be understood that even if the object being transported is not a patient, these same difficulties would be experienced, specifically the ability to lift and position the object on the support apparatus.

Examples of apparatuses that try to alleviate these problems include Chinese Patent No. CN102697616A; U.S. Pat. Nos. 3,871,036; 4,669,137; 6,971,126; 7,200,881; U.S. Patent Application Publication No. 2012/0291196; International Application No. PCT/GB00/03992; and International Application No. PCT/GB2003/004623. However, none of the foregoing are able to provide a support apparatus or stretcher that permits transportation of the patient without having move the patient onto the stretcher at all. Thus, the forgoing pinching and patient transfer issues still do exist in the art.

Accordingly, what is needed is an improved support apparatus, such as a stretcher, that facilitates and entirely eliminates these patient/object transfer issues. However, in view of the art considered as a whole at the time the present invention was made, it was not obvious to those of ordinary skill in the field of this invention how the shortcomings of the prior art could be overcome.

All referenced publications are incorporated herein by reference in their entirety. Furthermore, where a definition or use of a term in a reference, which is incorporated by reference herein, is inconsistent or contrary to the definition of that term provided herein, the definition of that term provided herein applies and the definition of that term in the reference does not apply.

While certain aspects of conventional technologies have been discussed to facilitate disclosure of the invention, Applicants in no way disclaim these technical aspects, and it is contemplated that the claimed invention may encompass one or more of the conventional technical aspects discussed herein.

The present invention may address one or more of the problems and deficiencies of the prior art discussed above. However, it is contemplated that the invention may prove useful in addressing other problems and deficiencies in a number of technical areas. Therefore, the claimed invention should not necessarily be construed as limited to addressing any of the particular problems or deficiencies discussed herein.

In this specification, where a document, act or item of knowledge is referred to or discussed, this reference or discussion is not an admission that the document, act or item of knowledge or any combination thereof was at the priority date, publicly available, known to the public, part of common general knowledge, or otherwise constitutes prior art under the applicable statutory provisions; or is known to be relevant to an attempt to solve any problem with which this specification is concerned.

BRIEF SUMMARY OF THE INVENTION

The long-standing but heretofore unfulfilled need for improved support apparatus that permits little-to-no movement of an object or individual during transport is now met by a new, useful, and nonobvious invention.

In an embodiment, the current invention is a support apparatus having a retracted position and an expanded position. The apparatus includes a first housing assembly including a housing containing at least one wheel or roller, a main frame extending along a length of the apparatus forming an open space therewithin, first and second sheets, and a double roller assembly. In the retracted position, the first sheet is substantially coiled around the wheel or roller, and the second sheet is substantially coiled within the housing assembly. In the expanded position, the first sheet is substantially uncoiled from the wheel or roller, and the second sheet is substantially uncoiled and extending out of the housing assembly into the open space. The double roller assembly has ends disposed within the main frame during transition to and from the extended position. The double roller assembly includes a lead roller and a trail roller that are vertically and horizontally displaced from each other. The lead and trail rollers are directly or indirectly coupled to each other, such that they jointly and mutually travel along the main frame during transitions between the retracted and extended positions. The first sheet is disposed or looped around the lead roller and has an end affixed to the first housing assembly. The second sheet is disposed or looped around the trail roller and also has an end affixed to or proximal to the first housing assembly. The support apparatus transitions from its retracted position to its extended position by the wheel or roller in the housing rotating in a manner to extend the sheets into and along the open space. The support apparatus transitions from its extended position to its retracted position by the wheel or roller in the housing rotating in a manner to retract the sheets from the open space and toward the first housing assembly.

The double roller assembly may further include a stabilizer that couples the lead and trail rollers together on each end of the double roller assembly. This facilitates the joint and mutual movement of the rollers along the main frame.

The lead roller may be disposed above the trail roller with the first sheet being the top sheet that extends under the object or individual being lifted. The top sheet would also help support the weight of that object or individual. In this embodiment, the trail roller would be disposed under the lead roller, and the second sheet would be the bottom sheet that extends along the ground or other surface on which the support apparatus is positioned.

The second sheet may be substantially coiled around the wheel or roller in the first housing assembly in the retracted position, and it can be substantially uncoiled from the wheel or roller in the extended position.

The first and second sheets may have ends opposite their affixed ends that are affixed to a flexible interior layer. In turn, the flexible interior layer would be coiled around the wheel or roller in the first housing assembly in the retracted position, and it would be at least partially uncoiled from the wheel or roller in the extended position. Alternatively, the first and second sheets may have ends opposite their affixed ends that are affixed to a rigid backing, where the rigid backing is collapsed in the first housing assembly in the retracted position and is extended from the first housing assembly between the sheets in the extended position.

In yet another embodiment, in the retracted position, the second sheet may be substantially coiled around a second wheel or roller in the first housing assembly, and in the extended position, it would be substantially uncoiled from the second wheel or roller. In an embodiment, the first wheel/roller may be disposed on or through a driving gear, and the second wheel/roller may be disposed on or through a driven gear. The driving and driven gears would be meshed, such that rotation of the driving gear drives rotation of the driven gear, thus driving extension and retraction of the first and second sheets in the open space. In an alternative embodiment, the first wheel/roller may include a driver pulley, and the second wheel/roller may include a driven pulley. The driving pulley and driven pulley would be in communication with each other via an infinity belt, such that rotation of the driver pulley drives rotation of the driven pulley, thus driving extension and retraction of the first and second sheets in the open space.

The main frame may be angled or bent in a manner to permit positioned in a low Fowler's position, a semi-Fowler's position, a Fowler's position, or a combination thereof. Further, a high Fowler's position can be achieved by including a back support in perpendicular relation to the main frame.

The support apparatus may further include a second housing assembly disposed on an opposite side of the main frame from the first housing assembly. The second housing assembly includes a housing containing a third wheel or roller. In these embodiments, the apparatus further comprises a chain or belt assembly including a chain or belt looped or disposed around the third wheel or roller, where the chain/belt assembly has a first end affixed to the double roller assembly.

In a further embodiment, the first housing assembly may be positioned on a superior end of the support apparatus, and the second housing assembly may be positioned on an inferior end of the support apparatus.

In another embodiment, the chain or belt may be looped or disposed around a wheel mounted on first wheel or roller in the first housing assembly. Here, both ends of the chain or belt would be affixed to the double roller assembly.

In yet another embodiment, the chain or belt assembly may further include a compression spring that has a resilient bias toward being compressed, where the compression spring has an end coupled to the chain/belt and an opposite end coupled to the double roller assembly. In a further embodiment, an opposite end of the chain/belt may be affixed to the double roller assembly. Alternatively, the chain/belt may be looped or disposed around a wheel mounted on the lead roller, and the opposite end of the chain/belt would be affixed to the second housing assembly. In this case, an infinity belt may be disposed between the lead roller and the trail roller.

In an embodiment where the second housing assembly and third wheel/roller are included, the third wheel/roller can rotate in a clockwise direction during extension and counterclockwise direction during retraction. In a further embodiment, during extension, the first wheel/roller in the first housing assembly rotates in a clockwise direction, the lead roller rotates in a counterclockwise direction, and the trail roller rotates in a clockwise direction. During retraction, the first wheel/roller in the first housing assembly rotates in a counterclockwise direction, the lead roller rotates in a clockwise direction, and the trail roller rotates in a counterclockwise direction.

In yet a further embodiment, the support apparatus can operate as follows. When an object or patient is positioned within the open space, the first wheel/roller rotates, the third wheel/roller rotates, the chain or belt assembly pulls the double roller assembly toward the second housing assembly, and the lead and trail rollers rotate and travel along the main frame, thus extending the first and second sheets along the open space and underneath the object or individual to be transported until the extended position is achieved and the object or individual can be lifted and transported while being supported at least by the first and second sheets.

These and other important objects, advantages, and features of the invention will become clear as this disclosure proceeds.

The invention accordingly comprises the features of construction, combination of elements, and arrangement of parts that will be exemplified in the disclosure set forth hereinafter and the scope of the invention will be indicated in the claims.

BRIEF DESCRIPTION OF THE DRAWINGS

For a fuller understanding of the invention, reference should be made to the following detailed description, taken in connection with the accompanying drawings, in which.

DETAILED DESCRIPTION OF THE PREFERRED EMBODIMENT

In the following detailed description of the preferred embodiments, reference is made to the accompanying drawings, which form a part thereof, and within which are shown by way of illustration specific embodiments by which the invention may be practiced. It is to be understood that other embodiments may be utilized and structural changes may be made without departing from the scope of the invention.

As used in this specification and the appended claims, the singular forms "a", "an", and "the" include plural referents unless the content clearly dictates otherwise. As used in this specification and the appended claims, the term "or" is generally employed in its sense including "and/or" unless the context clearly dictates otherwise.

Figure 1:
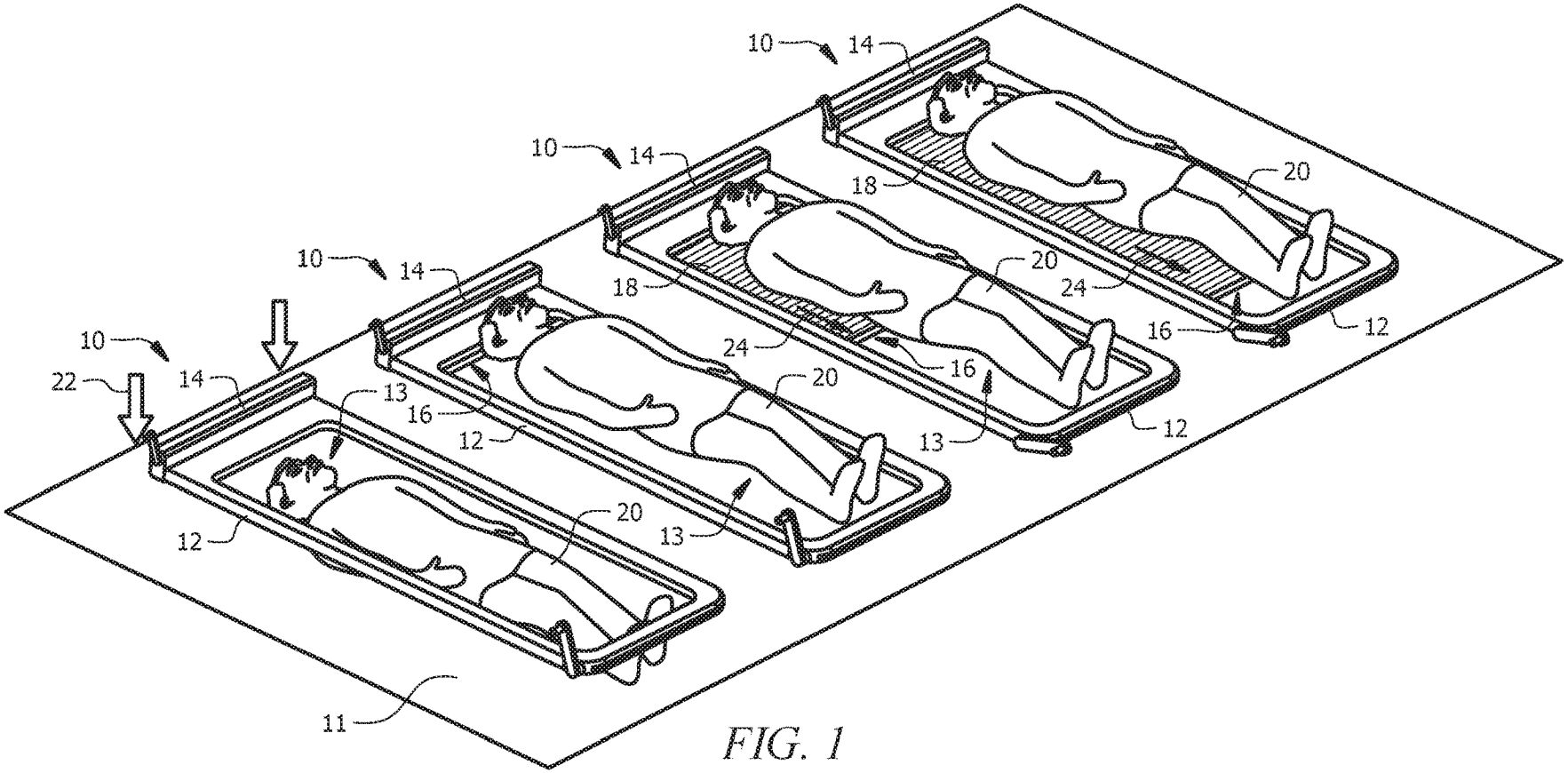
FIG. 1 depicts a general methodology of positioning a patient in overlying relation to the support sheet of the current apparatus.
Figure 2A:
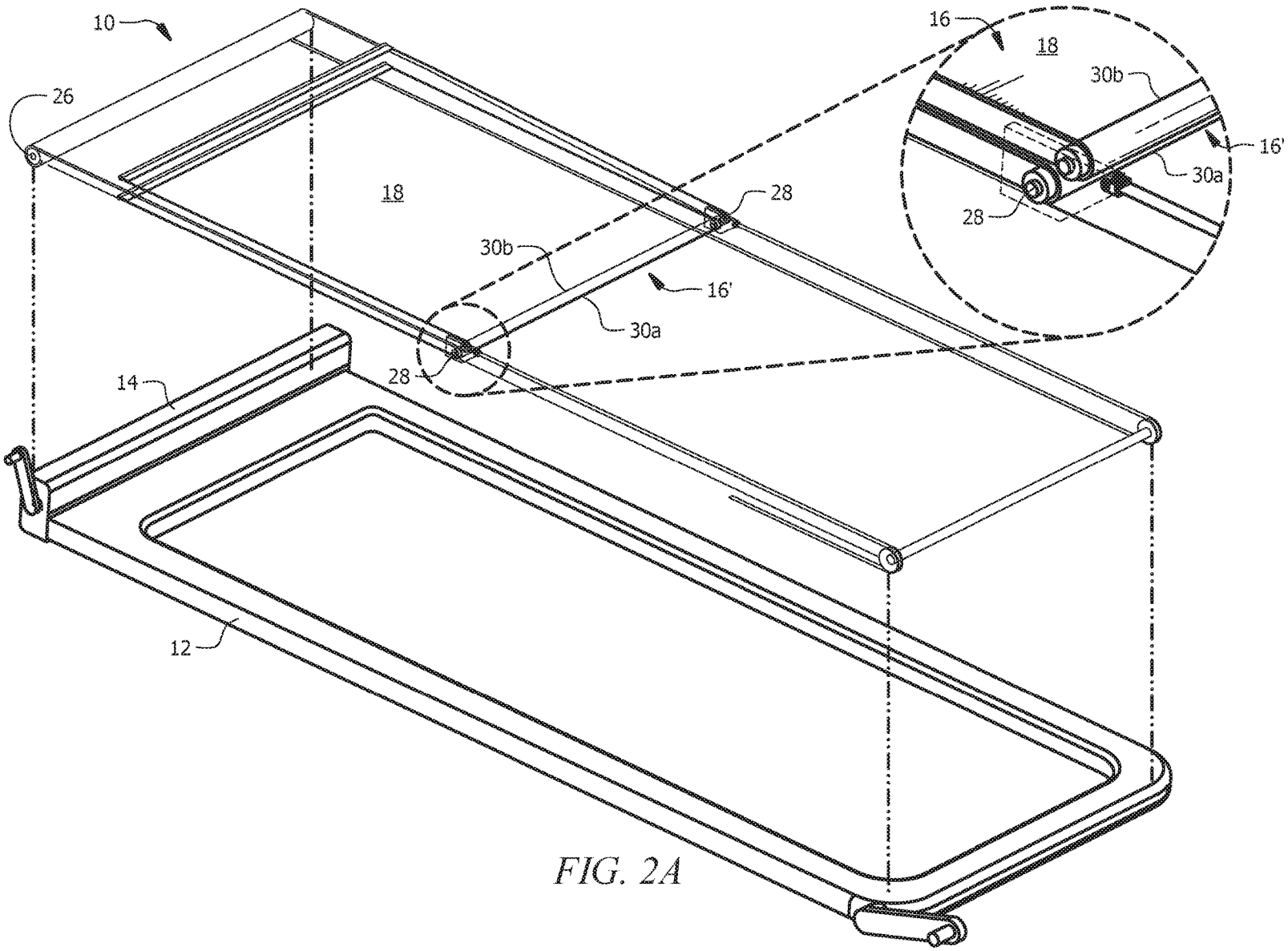
FIG. 2A is a perspective semi-exploded view of the current apparatus mid-extension or mid-retraction of the support mechanism with a patient positioned in overlying relation thereto. Also shown is a close-up view of the double roller mechanism.
Figure 2B:
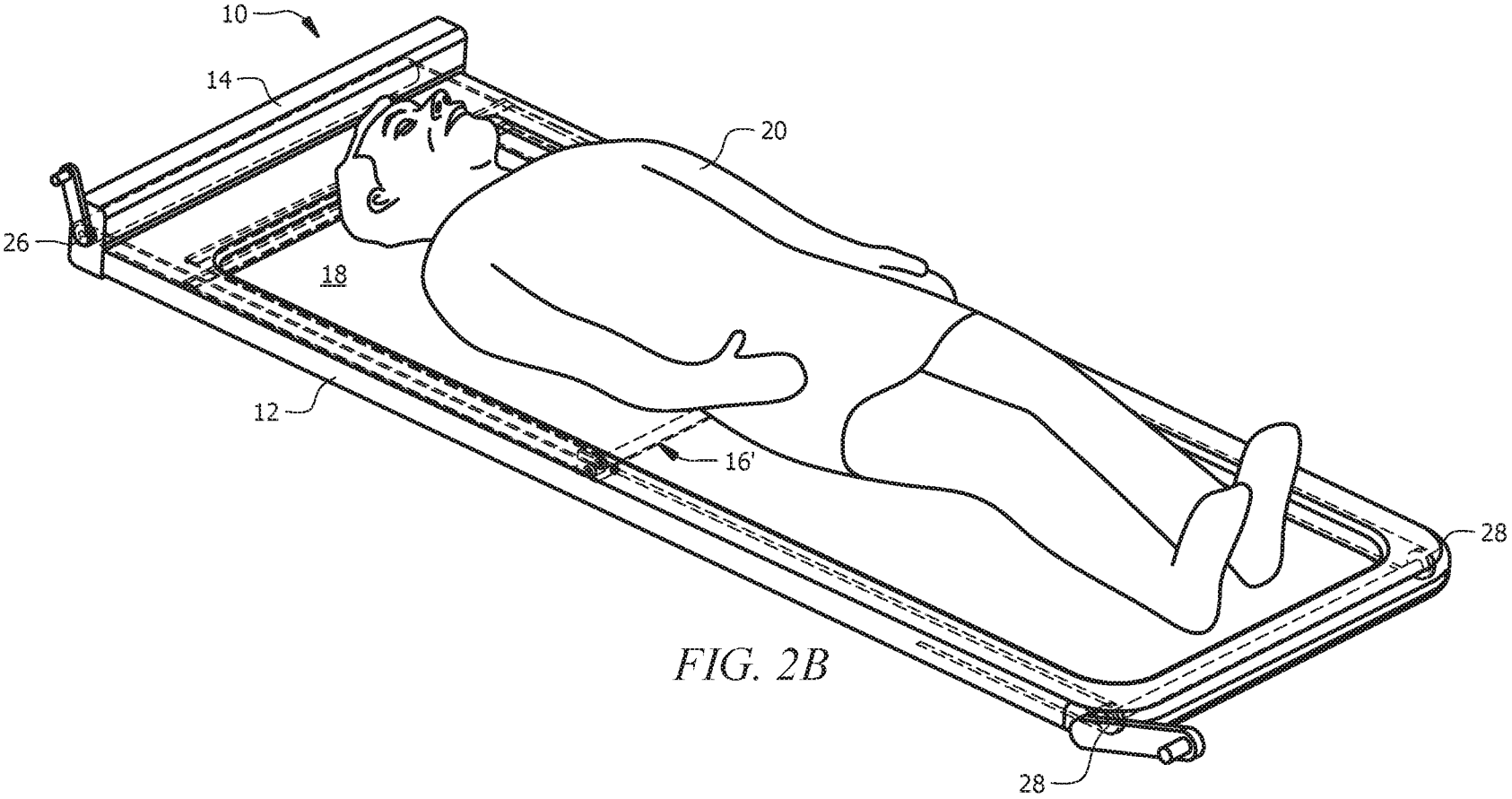
FIG. 2B is a perspective view of the assembled apparatus but without the patient shown in FIG. 2A.

In an embodiment, as can be seen in FIGS. 1 and 2A-2B, the current invention is a support apparatus (e.g., stretcher for medical purposes), generally denoted by the reference numeral 10, including main frame 12 with housing 14, and support mechanism 16 with support sheet 18. FIG. 1 depicts the general methodology of positioning patient 20 in overlying relation to support apparatus 10. In its initial position, support mechanism 16 is disposed within housing 14, leaving main frame 12 with open space 13 disposed therewithin. Patient 20 is disposed through open space 13 by placing main frame 12 over top patient 20 in the direction indicated by arrow 22.

When patient 20 has been disposed through open space 13 and main frame 10 is laying on the surface on which patient 20 is positioned (e.g., ground or floor 11), support mechanism 16 is actuated and begins extending out of housing 14 (i.e., within open space 13) and along the longitudinal axis of main frame 12 in the direction indicated by arrow 24. In its final, extended position, support mechanism 16 has fully extended across main frame 12, and open space 13 closes. In this position, support sheet 18 is disposed completely in underlying relation to patient 20, and apparatus 10 can be lifted with support sheet 18 fully supporting the weight of patient 20.

This completely eliminates the patient transfer issues seen in the conventional art, as patient 20 does not need to be lifted or substantially moved in any way prior to being supported by apparatus 10 and transported using apparatus 10. Further, this mechanism eliminates any risk of pinching or otherwise harming patient 20, as support mechanism 16 is nearly frictionless as it extends along main frame 12 in the direction indicated by arrow 24, thus allowing sheet 18 to be extended underneath patient 20 without difficult. This "nearly frictionless" aspect of the current invention will become clearer as this specification continues as well.

FIGS. 2A-2B are wireframe views of support apparatus 10. Of particular relevance in these figures is the depiction of sprockets, gears, or pulleys 26 (collectively wheels 26) and sprockets, gears, or pulleys 28 (collectively wheels 28). One set of wheels 26 are disposed at the superior end of main frame 12 (i.e., proximal to where the head of patient 20 is positioned), though one of wheels 26 cannot be seen but is disposed directly on the other side main frame 12. Another set of wheels 28 are disposed at the inferior end of main frame 12 (i.e., proximal to where the feet of patient 20 are positioned). As support mechanism 16 extends along main frame 12 and within open space 13, wheels 26 remain fixed or stationary within housing 14 and wheels 28 travel with leading edge 16' of support mechanism 16.

Further, FIG. 2A also shows a close-up of leading edge 16' of support mechanism 16, showing first (leading) roller 30*a* and second (trailing) roller 30*b*. Typically, rollers 30*a*, 30*b* are not positioned directly on top of each other vertically, but they are vertically and horizontally displaced, as will become clearer as this specification continues.

Support sheet 18 is disposed between and around wheels 26, wheels 28, first roller 30*a*, and second roller 30*b* in such a way it is coiled or collapsed within housing 14 in the initial position of apparatus 10, and it is disposed along main frame 12 within open space 13 as support mechanism 16 extends underneath patient 20. As such, sheet 18 should have at least two (2) fixed points of contact near the superior end of main frame 12. This disposition and mechanism will also become clearer as this specification continues.

It can be understood that in the embodiments of the current invention described herein, housing 14 and support mechanism 16 are initially disposed at the superior end of apparatus 10 (i.e., where the head of patient 20 would be positioned), and support mechanism 16 and sheet 18 extend in a superior-to-inferior position. However, the current invention contemplates that housing 14 and support mechanism 16 can be initially disposed at the inferior end of apparatus 10 (i.e., where the feet of patient 20 would be positioned), and support mechanism 16 and sheet 18 can extend in an inferior-to-superior position in substantially the same way as described supra and as will be described infra.

Example 1

FIGS. 3A-3B & 4A-4B

Figure 3A:
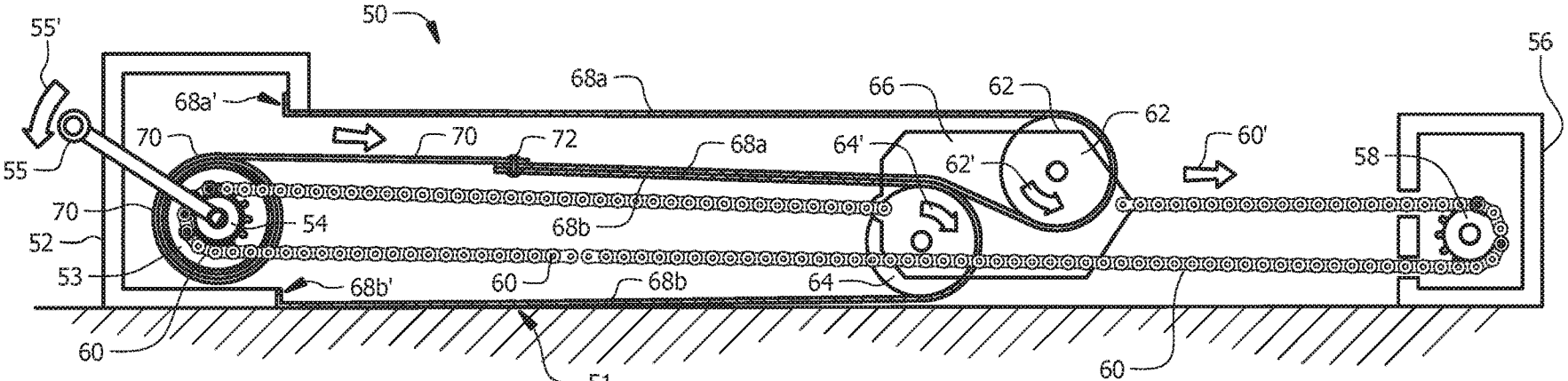
FIG. 3A is an isometric view of the support mechanism in an extended position.
Figure 3B:
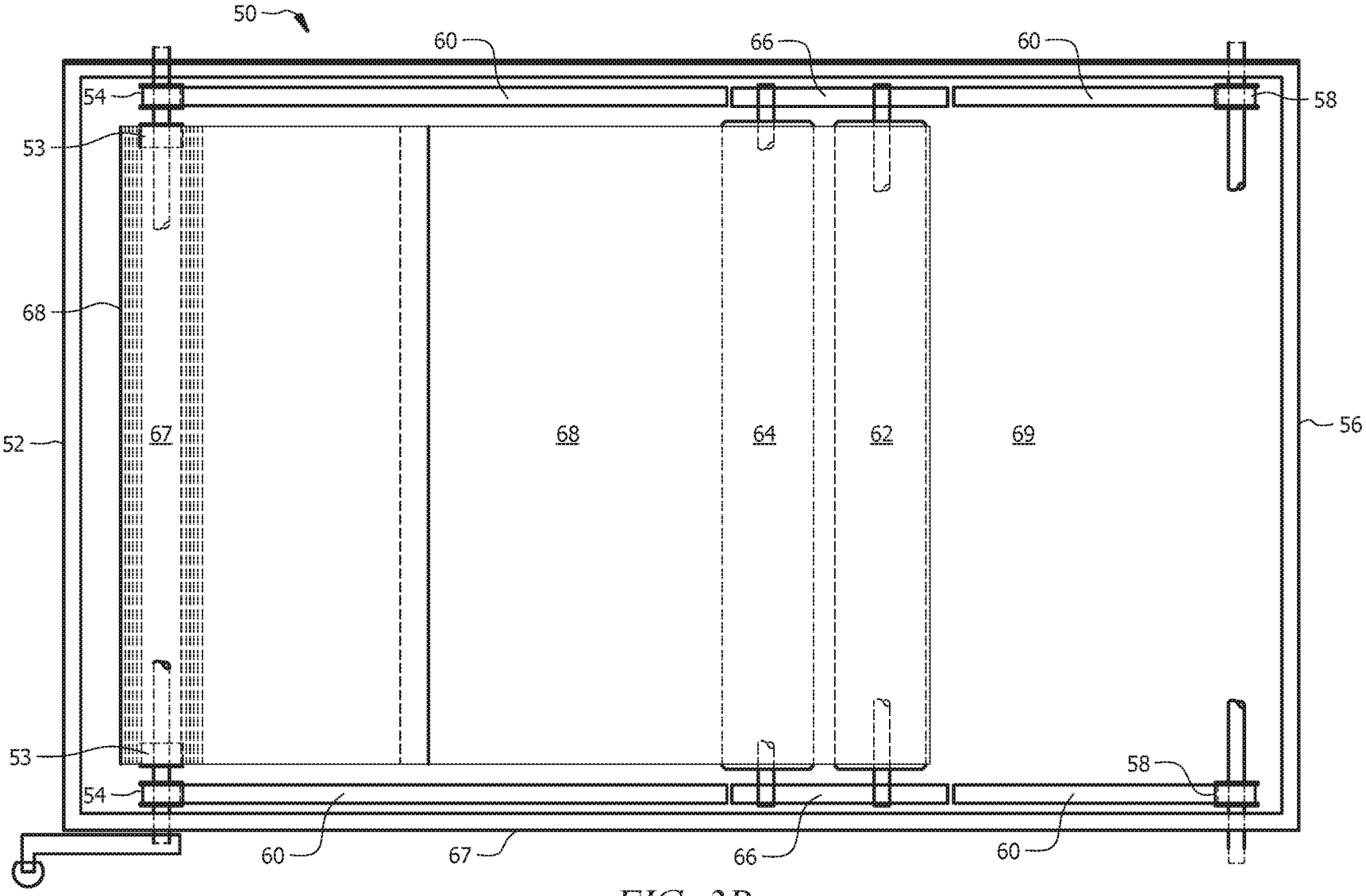
FIG. 3B is an isometric view of the support mechanism in a retracted position.
Figure 4A:
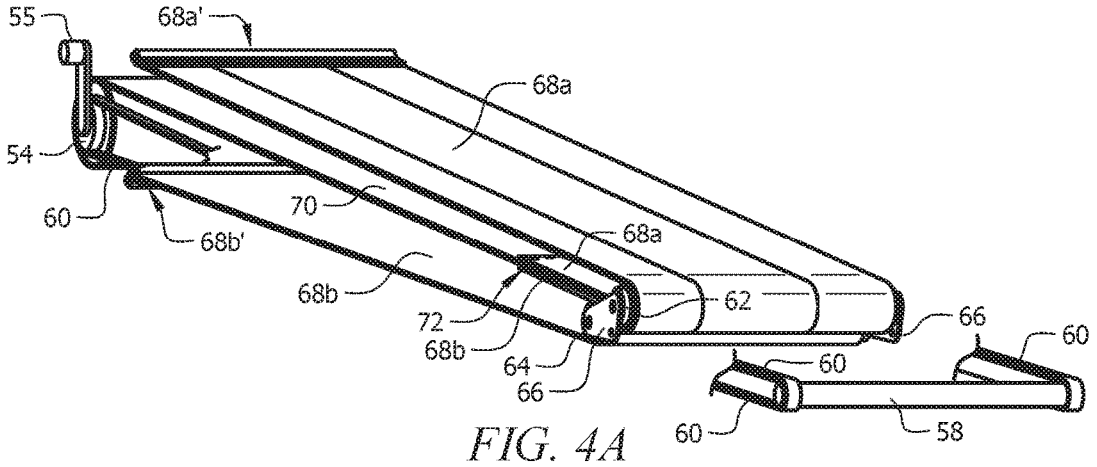
FIG. 4A is a cross-sectional side view of a support apparatus, according to an embodiment of the current invention.
Figure 4B:
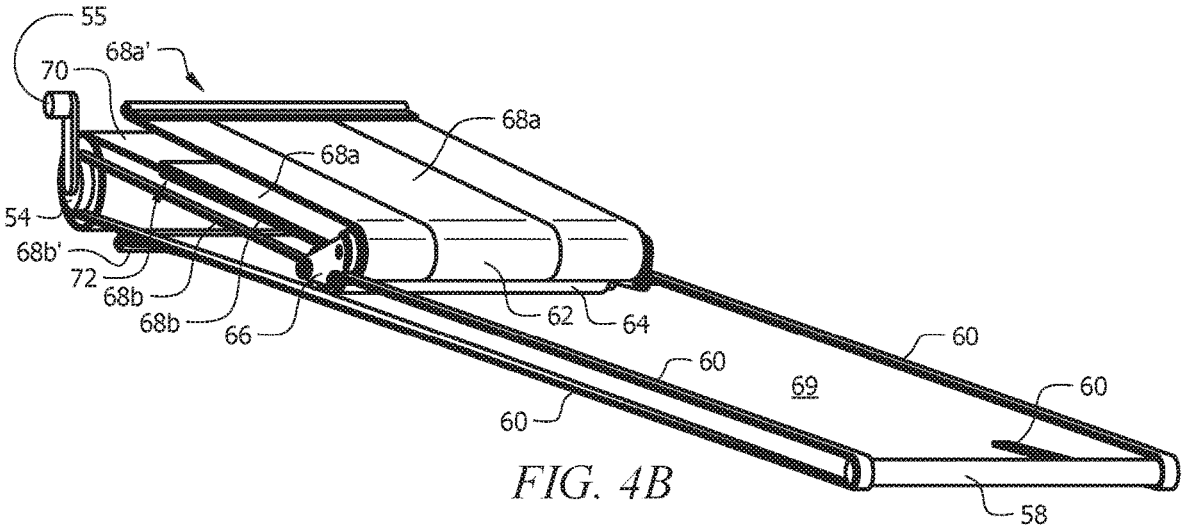
FIG. 4B is a cross-sectional top view of the support apparatus of FIG. 3, according to an embodiment of the current invention.

FIGS. 3A-3B & 4A-4B include various views of a support apparatus, generally denoted by the reference numeral 50, according to certain embodiments of the current invention, resting on ground 51. Apparatus 50 includes superior housing 52 substantially enclosing wheel or roller 53 and wheel 54, both of which are controlled by handle/lever 55. It can be understood that the current invention is described herein with manually-operated handles and/or levers, but the powering and controlling of the actuation of apparatus 50 can be manual, electronic, automated, or other mechanism known in the art. Apparatus 50 also includes inferior housing 56 substantially enclosing wheel or roller 58 (wheel is seen in FIG. 3B, and roller is seen in FIGS. 4A-4B).

Figure 5A:
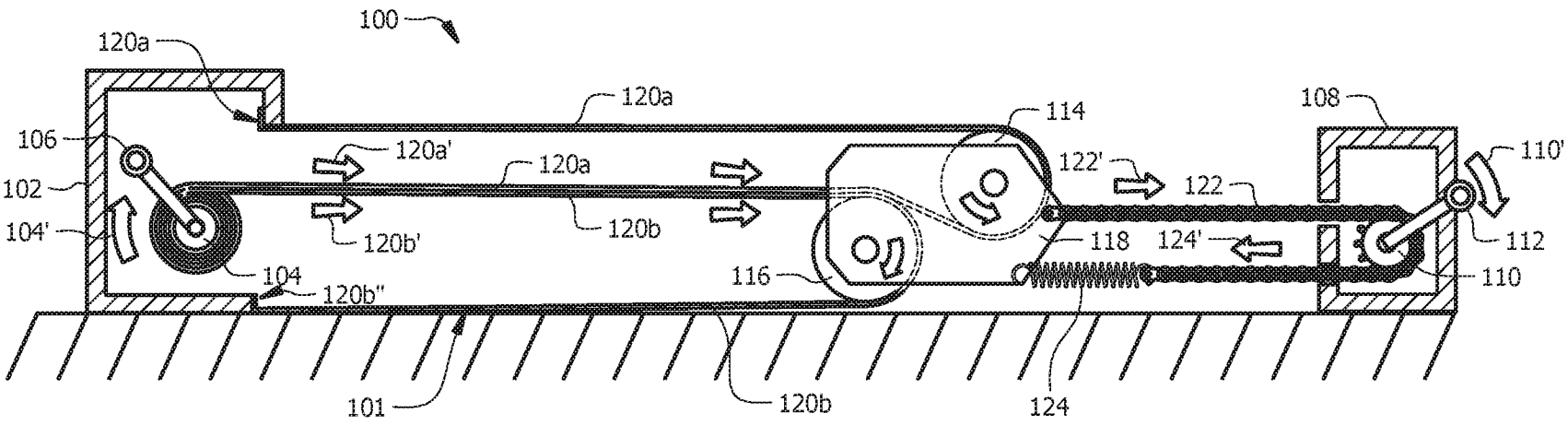
FIG. 5A is a cross-sectional side view of an embodiment of the support apparatus during extension.

The support mechanism includes chain or belt 60 (chain is seen in FIG. 5A, and belt is seen in FIGS. 4A-4B) disposed around wheels 54, 58 (see FIG. 5A in particular) and thus rotates or travels along the length of apparatus 50 based on rotation of wheels 54, 58. Chain or belt 60 follows a path of travel from a fixed position on an inferior end of stabilizer 66, around wheel 58, along a longitudinal extent of apparatus 50, around wheel 54, and to a fixed position on a superior end of stabilizer 66.

The support mechanism further includes lead roller 62, trail roller 64, stabilizer 66 that couples and stabilizes lead roller 62 and trail roller 64 together, flexible top sheet 68*a* disposed around lead roller 62, flexible bottom sheet 68*b* disposed around trail roller 64, and flexible interior layer 70 coupled to top sheet 68*a* and bottom sheet 68*b* at point 72.

Top sheet 68*a* has fixed connection 68*a*' at the top of superior housing 52 and follows a path of travel from said fixed position 68*a*', down and around lead roller 62, and to a fixed position at point 72 connected to flexible interior layer 70. Bottom sheet 68*b* has fixed connection 68*b*' at the bottom of superior housing 52 and follows a path of travel from said fixed position 68*b*', up and around trail roller 64, and to a fixed position at point 72 connected to flexible interior layer 70. As can be seen, top sheet 68*a* and bottom sheet 68*b* abut one another between top sheet 68*a* and bottom sheet 68*b*.

As noted, interior layer 70 is fixedly coupled to top sheet 68*a* and bottom sheet 68*b*. Interior layer 70 is flexible and thus can wrap/coil around wheel or roller 53 prior to and during actuation of apparatus 50. As such, both top sheet 68*a* and bottom sheet 68*b* can also wrap/coil around wheel or roller 53 prior to and during actuation of apparatus 50.

In its retracted position, apparatus 50 includes top sheet 58*a*, bottom sheet 58*b*, and interior layer 70 wrapped/coiled around wheel/roller 53, thus leaving open space 69 within main frame 67 and between chains/belts 60 (see FIG. 3B). As apparatus 50 is actuated, for example by actuating handle 55 in the direction indicated by arrow 55', wheel 54 rotates in a clockwise direction and wheel 58 rotates in a clockwise direction, thus causing chain/belt 60 to move in the direction indicated by arrow 60'.

Actuating apparatus 50 in such a manner also causes roller/wheel 53 to rotate in a clockwise direction, causing or signaling lead roller 62 to rotate in a counterclockwise direction (see arrow 62') and trail roller 64 to rotate in a clockwise direction (see arrow 64'). Thus, top sheet 68*a*, bottom sheet 68*b*, and interior layer 70 uncoil from roller/wheel 53 and extend into open space 59 between chains/belts 60 in a direction indicated by arrow 70'. More generally speaking, sheet 68 begins to fill empty space 69 (see FIG. 3B) in underlying relation to the patient.

Top sheet 68*a* being fixed at point 68*a*' allows top sheet 68*a* to continue to uncoil and extend into open space 69 as lead roller 62 travels toward inferior housing 56. In this way, top sheet 68*a* can also remain taut underneath the patient. Similarly, bottom sheet 68*b* being fixed at point 68*b*' allows bottom sheet 68*b* to continue to uncoil and extend into open space 69 as trail roller 64 travels toward inferior housing 56. In this way, bottom sheet 68*b* can also remain taut underneath the patient.

Example 2

FIGS. 5A-5B

Figure 5B:
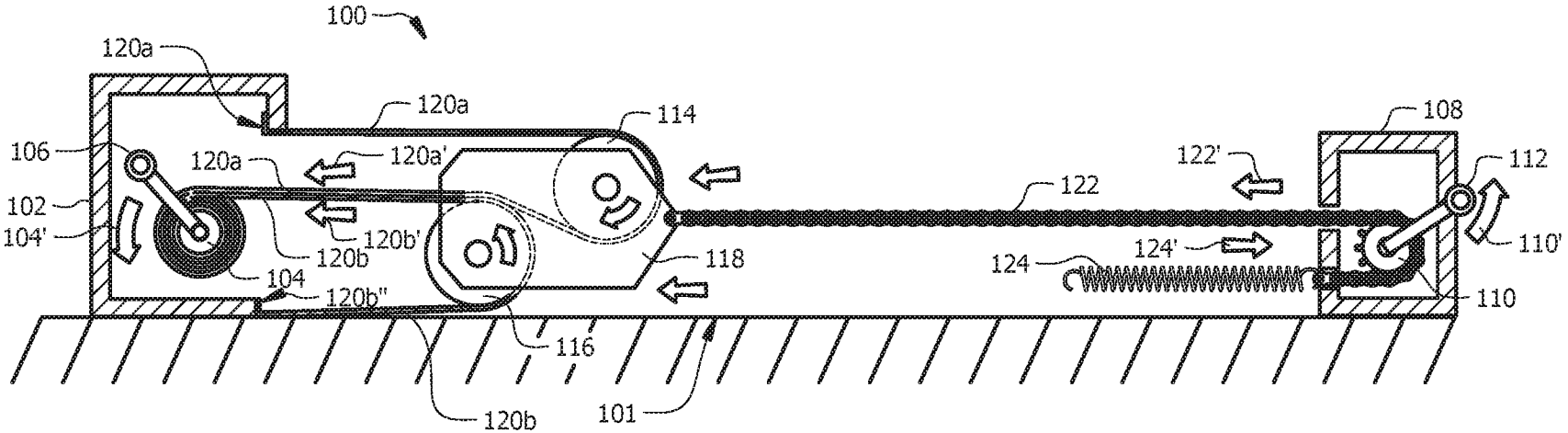
FIG. 5B is a cross-sectional side view of an embodiment of the support apparatus during retraction.

FIGS. 5A-5B depict a support apparatus, generally denoted by the reference numeral 100, according to certain embodiments of the current invention, resting on ground 101 during both extension (FIG. 5A) and retraction (FIG. 5B). Apparatus 100 includes superior housing 102 substantially enclosing wheel or roller 104, which is controlled by handle/lever 106. It can be understood that the current invention is described herein with manually-operated handles and/or levers, but the powering and controlling of the actuation of apparatus 100 can be manual, electronic, automated, or other mechanism known in the art. Apparatus 100 also includes inferior housing 108 substantially enclosing wheel or roller 110, which is controlled by handle/lever 112.

The support mechanism includes lead roller 114, trail roller 116, stabilizer 118 that couples and stabilizes lead roller 114 and trail roller 116 together, flexible top sheet 120*a* disposed around lead roller 114, and flexible bottom sheet 120*b* disposed around trail roller 116. As opposed to Example 1, apparatus 100 does not include a flexible interior layer coupled to the top and bottom sheets. Rather, top sheet 120*a* and 120*b* abut each other between top sheet 120*a* and bottom sheet 120*b* and together coil and uncoil from wheel or roller 104. In other words, both top sheet 120*a* and bottom sheet 120*b* can also wrap/coil around wheel or roller 104 prior to and during actuation of apparatus 100.

Top sheet 120*a* has fixed connection 120*a*" at the top of superior housing 102 and follows a path of travel from said fixed position 120*a*", down and around lead roller 114, and around wheel or roller 104. Bottom sheet 120*b* has fixed connection 120*b*" at the bottom of superior housing 102 and follows a path of travel from said fixed position 120*b*", up and around trail roller 116, and around wheel or roller 104.

The support mechanism further includes chain or belt 122 disposed around wheel or roller 110 and thus rotates or travels along the length of apparatus 100 based on rotation of wheels 110. Chain or belt 122 follows a path of travel from a fixed position on an inferior end of stabilizer 118, around wheel 110, and terminates at spring 124. Spring 124 has an inherent bias toward a coiled or tighter disposition and can be coupled to stabilizer 118 or other component of the support mechanism. This is not explicitly seen in the figures but can be understood by one of ordinary skill in the art.

In its retracted position, apparatus 100 includes top sheet 120*a* and bottom sheet 120*b* wrapped/coiled around wheel/roller 104, thus leaving an open space within the main frame and between chains/belts 122. As apparatus 100 is actuated (see FIG. 5A), for example by actuating handle 106 in the direction indicated by arrow 104', wheel 104 rotates in a clockwise direction. Alternatively or in addition, handle 112 can be actuated in the direction indicated by arrow 110', causing wheel/roller 110 to rotate in a clockwise direction. Ultimately, chain/belt 122 should move in the direction indicated by arrow 122', and spring 124 should move in the direction indicated by arrow 124'.

The rotation of roller/wheel 104 in a clockwise direction causes or signals lead roller 114 to rotate in a counterclockwise direction and trail roller 116 to rotate in a clockwise direction. Thus, top sheet 120*a* uncoils from roller/wheel 104 and extends in direction indicated by arrow 120*a*', and bottom sheet 120*b* uncoils from roller/wheel 104 and extends in direction indicated by arrow 120*b*'.

Top sheet 120*a* being fixed at point 120*a*" allows top sheet 120*a* to continue to uncoil and extend in the direction 120*a*' as lead roller 114 travels toward inferior housing 108. In this way, top sheet 120*a* can also remain taut underneath the patient. Similarly, bottom sheet 120*b* being fixed at point 120*b*" allows bottom sheet 120*b* to continue to uncoil and extend in the direction 120*b*' as trail roller 116 travels toward inferior housing 108. In this way, bottom sheet 120*b* can also remain taut underneath the patient.

During retraction (see FIG. 5B), wheel/roller 104 is rotated in counterclockwise direction 104' and/or wheel/roller 110 is rotated in counterclockwise direction 110'. This causes lead roller 114 to rotate in a clockwise direction and trail roller 116 to rotate in a counterclockwise direction, in turn causing top sheet 120*a* to move in direction 120*a*', bottom sheet 120*b* to move in direction 120*b*', chain/belt to move in direction 122', and spring 124 to move in direction 124'. Typically, apparatus 100 would be fully retracted before spring 124 reaches wheel/roller 110.

Example 3

FIGS. 6A-6C

Figure 6A:
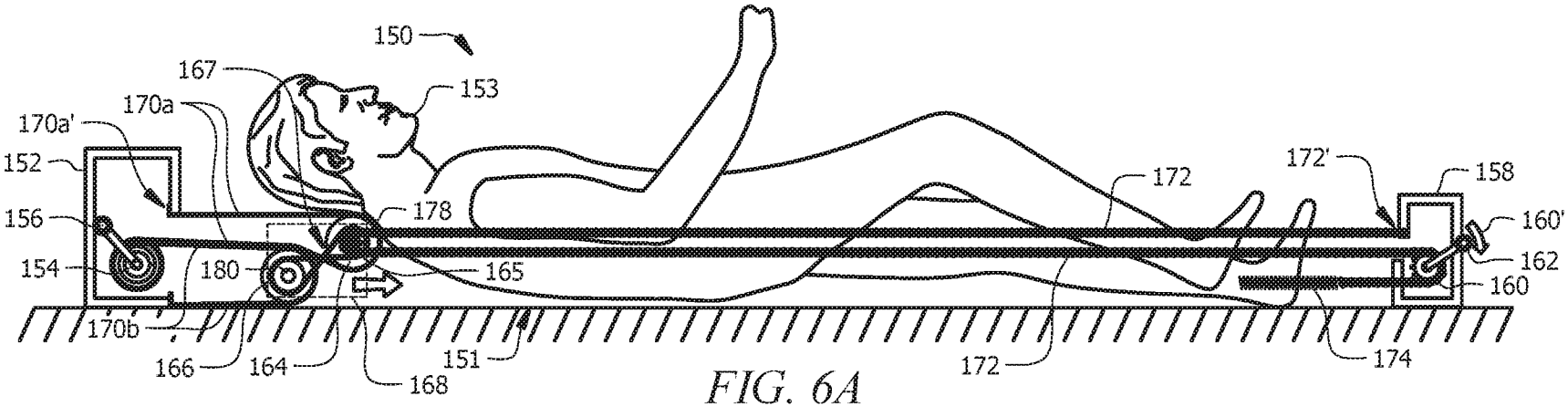
FIG. 6A is a side view of an embodiment of the current invention in use prior to extension of the support mechanism.
Figure 6B:
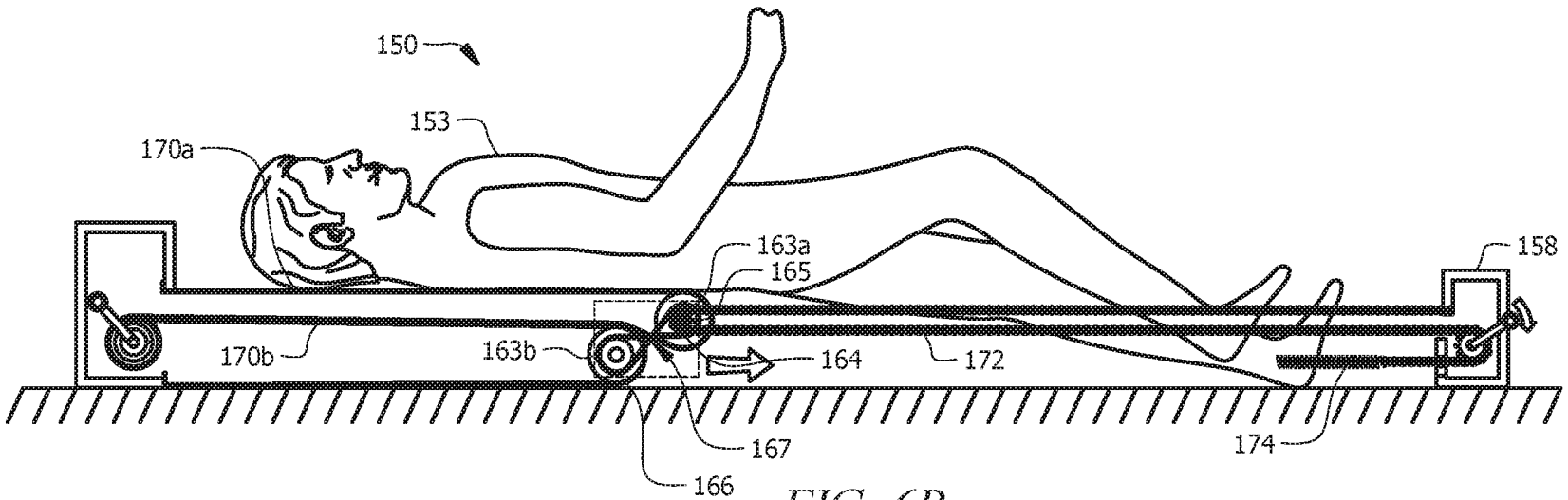
FIG. 6B is a side view of the embodiment of FIG. 6A in use during extension of the support mechanism.
Figure 6C:
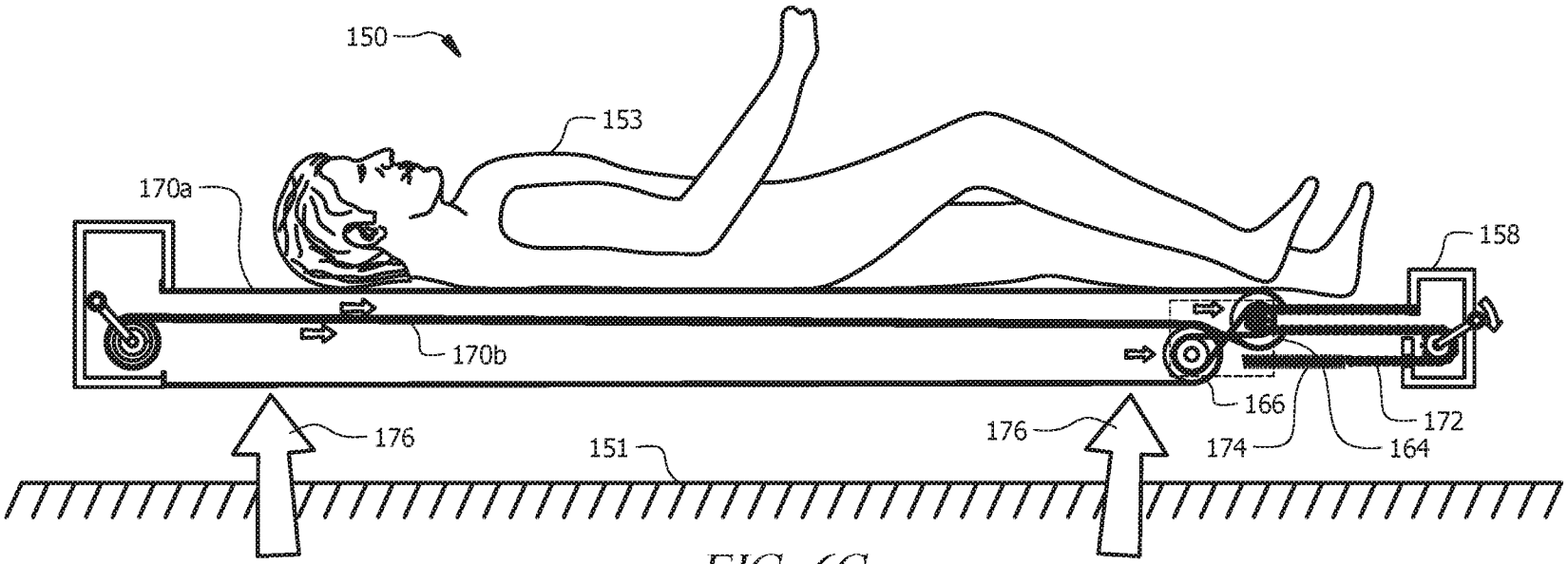
FIG. 6C is a side view of the embodiment of FIG. 6A in use with near-full extension of the support mechanism.

FIGS. 6A-6C depict a support apparatus, generally denoted by the reference numeral 150, according to certain embodiments of the current invention, in use, resting on ground 151 during initial extension (FIG. 6A), mid-extension (FIG. 6B), and full extension (FIG. 6C) under patient 153. Apparatus 150 includes superior housing 152 substantially enclosing wheel or roller 154, which is controlled by handle/lever 156. It can be understood that the current invention is described herein with manually-operated handles and/or levers, but the powering and controlling of the actuation of apparatus 150 can be manual, electronic, automated, or other mechanism known in the art. Apparatus 150 also includes inferior housing 158 substantially enclosing wheel or roller 160, which is controlled by handle/lever 162.

The support mechanism includes lead roller 164, trail roller 166, stabilizer 168 that couples and stabilizes lead roller 164 and trail roller 166 together, wheel 178 disposed on a face of roller 164, wheel 165 disposed on a face of wheel 178, flexible top sheet 170*a* disposed around lead roller 164, and flexible bottom sheet 170*b* disposed around trail roller 166. As opposed to Example 1, apparatus 150 also does not include a flexible interior layer coupled to the top and bottom sheets. Rather, top sheet 170*a* and 170*b* abut each other between top sheet 170*a* and bottom sheet 170*b* and together uncoil and coil from wheel or roller 154 during extension and retraction of the sheets. (i.e., during actuation of apparatus 150).

Top sheet 170*a* has fixed connection 170*a*' at the top of superior housing 152 and follows a path of travel from said fixed position 170*a*', down and around lead roller 164, and around wheel or roller 154. Bottom sheet 170*b* has fixed connection 170*b*' at the bottom of superior housing 152 and follows a path of travel from said fixed position 170*b*', up and around trail roller 166, and around wheel or roller 154.

The support mechanism further includes chain or belt 172 disposed around wheels 160, 165 and thus rotates or travels along the length of apparatus 150 based on rotation of wheels 160, 165. Chain or belt 172 has fixed connection 172' at the top of inferior housing 158 and follows a path of travel from said fixed position 172', along a longitudinal extent of apparatus 150, around wheel 165, along a longitudinal extent of apparatus 150, around wheel 160, and terminates at spring 174. Spring 174 has an inherent bias toward a coiled or tighter disposition and can be coupled to stabilizer 168 or other component of the support mechanism. This is not explicitly seen in the figures but can be understood by one of ordinary skill in the art.

In this embodiment, as opposed to Example 2, this embodiment includes optional infinity belt 167 disposed around wheel 178 and wheel 180. During actuation of apparatus 150, infinity belt 167 ties together rollers 164, 166, so that regardless of whether wheel/roller 154 is actuated or wheel/roller 160 is actuated, rollers 164, 166 travel in synchronization. Infinity belt 167 also facilitates the substantially frictionless rotation of wheels or rollers 164, 166, thus permitting top sheet 170*a* and bottom sheet 170*b* to extend relatively easily along the extent of apparatus 150 under patient 153 without pinching patient 153 or forcing patient 153 to move voluntarily.

In its retracted position, apparatus 150 includes top sheet 170*a* and bottom sheet 170*b* wrapped/coiled around wheel/roller 154, thus leaving an open space within the main frame and between chains/belts 172. As apparatus 150 is actuated (see FIGS. 6B-6C), for example by actuating handle 156, wheel 154 rotates in a clockwise direction. Alternatively or in addition, handle 168 can be actuated, causing wheel/roller 160 to rotate in a clockwise direction. Ultimately, chain/belt 122 should move in the direction to "pull" wheel 165 toward inferior housing 158.

The rotation of roller/wheel 154 in a clockwise direction causes or signals lead roller 164 to rotate in a counterclockwise direction and trail roller 166 to rotate in a clockwise direction. Thus, both top sheet 170*a* and bottom sheet 170*b* uncoil from roller/wheel 154, and together move in the direction indicated by the arrows in FIGS. 6A-6B.

As seen by the progression of FIGS. 6A-6C, top sheet 170*a* being fixed at point 170*a*' allows top sheet 170*a* to continue to uncoil and extend as lead roller 164 travels toward inferior housing 158. In this way, top sheet 170*a* can also remain taut underneath patient 153. Similarly, bottom sheet 170*b* being fixed at point 170*b*' allows bottom sheet 170*b* to continue to uncoil and extend as trail roller 166 travels toward inferior housing 158. In this way, bottom sheet 170*b* can also remain taut underneath patient 153. Additionally, chain or belt 172 being fixed at point 172' allows belt/chain 172 to continue to travel around wheels 160 and wheel 165 as it "pulls" rollers 164, 166 toward inferior housing 158. In this way, chain/belt 172 can also remain taut on either side of patient 153.

Now referring to FIG. 6C, when sheets 170*a* and 170*b* (extension of sheet 170*a* is most important) are fully extended, apparatus 150 can be lifted with patient 153 thereon in the direction indicated by arrows 176.

Figure 7A:
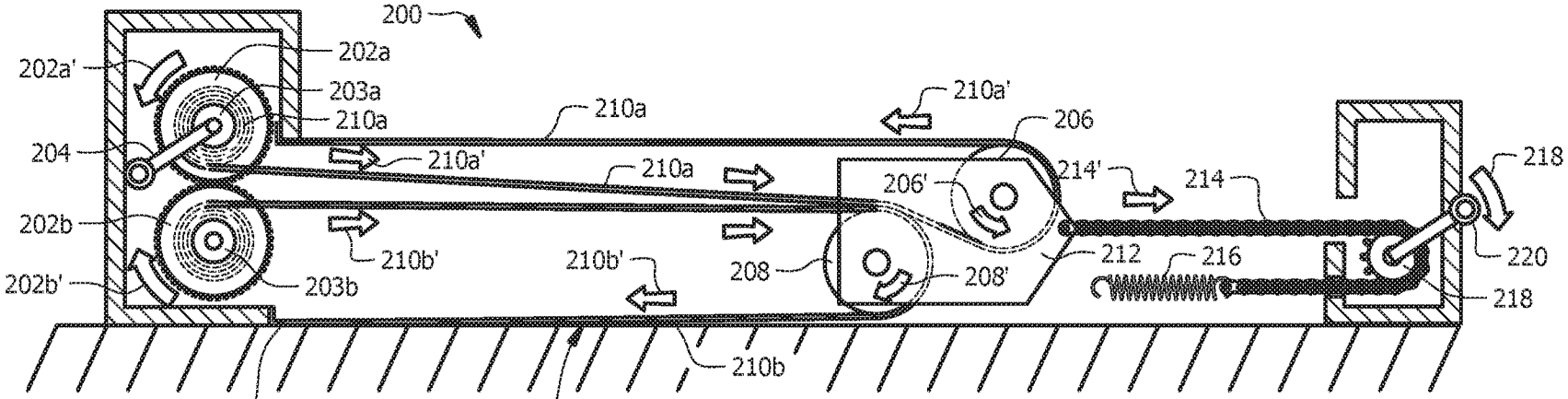
FIG. 7A is a cross-sectional side view of an alternate embodiment of the current invention.
Figure 7B:
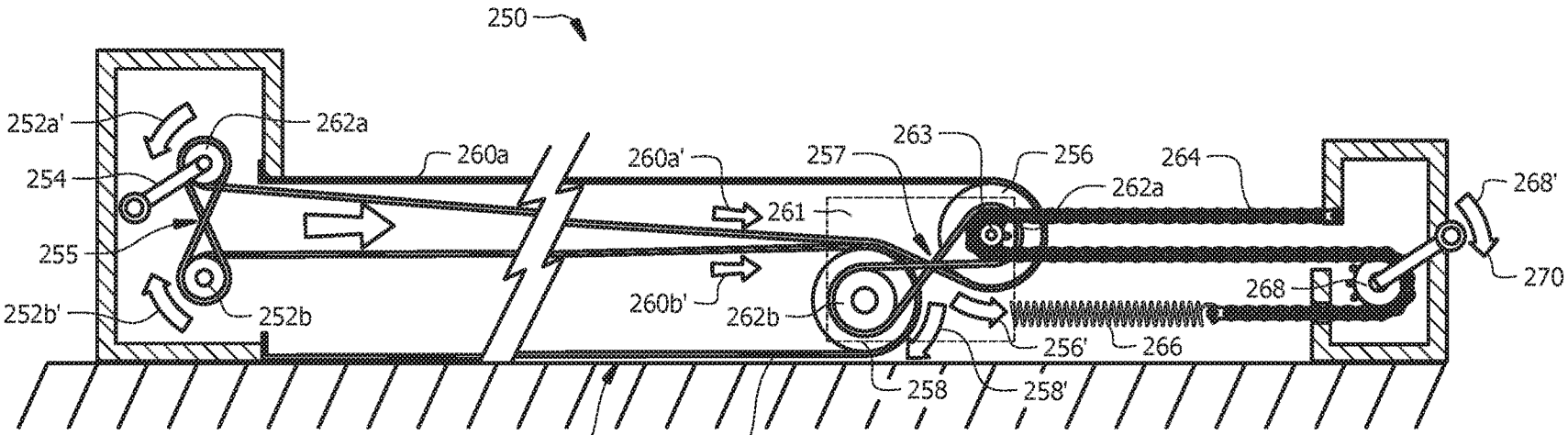
FIG. 7B is a cross-sectional side view of an alternate embodiment of the current invention.

Alternate Embodiments (FIGS. 7A-7B)

FIG. 7A is a cross-section of an alternate embodiment of a support apparatus, generally denoted by the reference numeral 200, resting on ground 201. As opposed to the previous Examples, apparatus 200 includes driving gear 202*a*, driving gear wheel 203*a* disposed on or through the center of gear 202*a*, driven gear 202*b* that is driven by driving gear 202*a*, and driven gear wheel 203*b* disposed on or through the center of gear 202*b*. Similar to the previous Examples, apparatus 200 further includes handle 204 capable of actuating driving gear 202*a*, lead roller 206, trail roller 208, top sheet 210*a*, bottom sheet 210*b*, stabilizer 212 that stabilizes and couples lead roller 206 and trail roller 208 together, chain or belt 214 disposed around wheel or roller 218, spring 216 coupled to chain/belt 214 (similar to the embodiment of FIGS. 5A-5B), and handle 220 capable of actuating wheel/roller 218.

However, top sheet 210*a* and bottom sheet 210*b* do not coil around and uncoil from the same wheel/roller, as in one or more of the previous embodiments described. Rather, top sheet 210*a* coils around and uncoils from driving gear wheel 203*a*, and bottom sheet 210*b* coils around and uncoils from driven gear wheel 203*b*.

During extension/actuation of apparatus 200, driving gear 202*a* rotates in the direction indicated by arrow 202*a*', causing both driven gear 202*b* to rotate in the opposite direction indicated by arrow 202*b*' and top sheet 210*a* to move in the directions indicated by arrows 210*a*'. In turn, rotation of driven gear 202*b* in direction 202*b*' causes bottom sheet 210*b* to move in the directions indicated by arrows 210*b*'. Rotation of lead roller 206 in direction 206' and rotation of trail roller 208 in opposing direction 208' further facilitate the extension of sheets 210*a*, 210*b* along the extent of apparatus 200. Rotation of wheel 218 in the direction indicated by arrow 218' also causes chain/belt 214 to move in the direction indicated by arrow 214'. This helps "pull" sheets 210*a*, 210*b* underneath the patient.

FIG. 7B is a cross-section of yet another embodiment of a support apparatus, generally denoted by the reference numeral 250, resting on ground 251. As opposed to the previous Examples, apparatus 250 includes driver pulley 252*a* and driven pulley 252*b* that is driven by driver pulley 252*a*. Similar to one or more of the previous Examples, apparatus 250 further includes handle 254 capable of actuating driver pulley 252*a*, lead roller 256, trail roller 258, top sheet 260*a* disposed around driver pulley 252*a* and lead roller 256, bottom sheet 260*b* disposed around driven pulley 252*b* and trail roller 258, stabilizer 261 that stabilizes and couples lead roller 256 and trail roller 258 together, wheel 262*a* disposed on or through lead roller 256, wheel 262*b* disposed on or through trail roller 258, wheel/sprocket 263 disposed on or through wheel 262*a*, chain or belt 264 disposed around wheel/sprocket 263 and around wheel/roller 268, spring 266 coupled to stabilizer 261 and to chain/belt 254 (similar to the embodiment of FIGS. 6A-6C), and handle 270 capable of actuating wheel/roller 268.

However, top sheet 260*a* and bottom sheet 260*b* do not coil around and uncoil from the same wheel/roller, as in one or more of the previous embodiments described. Rather, top sheet 260*a* coils around and uncoils from driver pulley 252*a*, and bottom sheet 260*b* coils around and uncoils from driven pulley 252*b*.

Contrasting with the embodiment of FIG. 7A, rather than having gears that mesh, optional infinity belt 255 is disposed around driver pulley 252*a* and driven pulley 252*b* to tie pulleys 252*a*, 252*b* together, so that they rotate in synchronization. Additionally, similar to Example 3, infinity belt 257 is disposed around wheel 262*a* and wheel 262*b* to tie wheels 262*a*, 262*b* together, so that they rotate in synchronization. During actuation of apparatus 250, infinity belt 255 facilitates the substantially frictionless rotation of wheels or rollers 252*a*, 252*b*, and infinity belt 257 facilitates the substantially frictionless rotation of wheels or rollers 256, 258. This permits top sheet 260*a* and bottom sheet 260*b* to extend relatively easily along the extent of apparatus 250 under the patient without pinching the patient or forcing the patient to move voluntarily.

During extension/actuation of apparatus 250, driver pulley 252*a* rotates in the direction indicated by arrow 252*a*', causing both driven pulley 252*b* to rotate in the opposite direction indicated by arrow 252*b*' and top sheet 260*a* to move in the direction indicated by arrows 260*a*'. In turn, rotation of driven pulley 252*b* in direction 252*b*' causes bottom sheet 260*b* to move in the direction indicated by arrows 260*b*'. Rotation of lead roller 256 in direction 256' and rotation of trail roller 258 in opposing direction 258' further facilitate the extension of sheets 260*a*, 260*b* along the extent of apparatus 250. Rotation of wheel 268 in the direction indicated by arrow 268' also causes chain/belt 264 to move in the direction indicated by arrow 264'. This helps "pull" sheets 260*a*, 250*b* underneath the patient.

Figure 8:
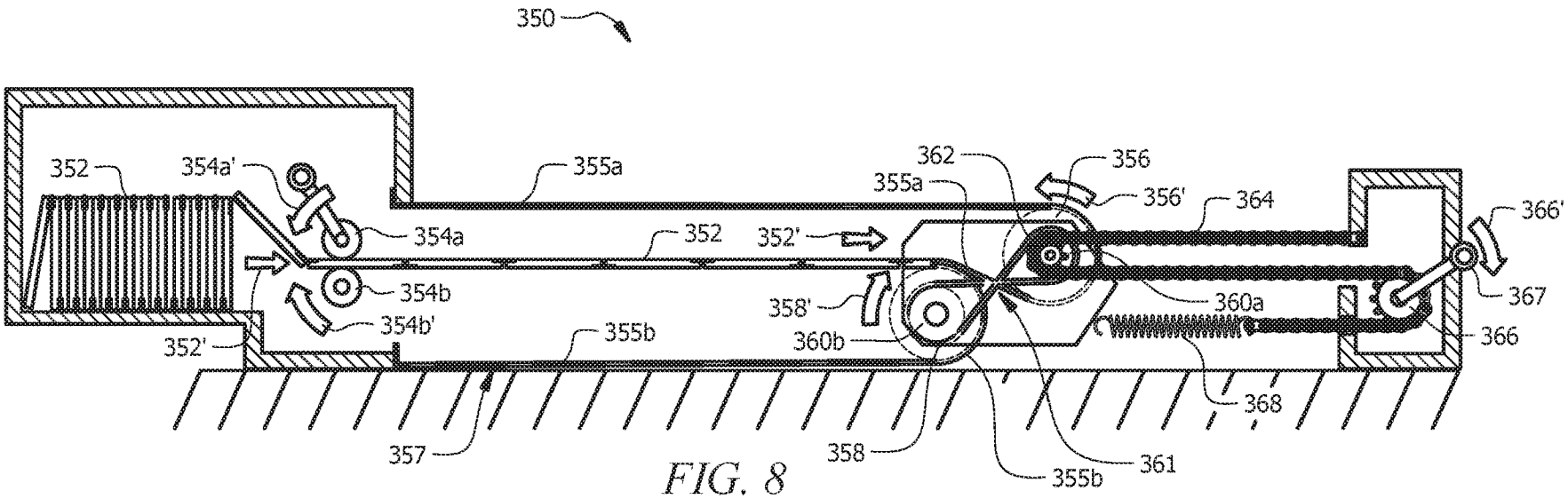
FIG. 8 depicts an embodiment of the current invention with a collapsible rigid backing disposed within the support mechanism.

Optional Rigid Backing (FIG. 8)

FIG. 8 depicts a support apparatus, depicted generally by the reference numeral 350, resting on ground 351 with expandable/collapsible rigid backing 352. In the initial retracted position of apparatus 350, rigid backing 352 is collapsed as can be seen on the left side of FIG. 8. To expand in the direction indicated by arrows 352', rigid backing 352 unfolds at the hinges seen and slides between first roller 354*a* and second roller 354*b*. As such, first roller 354*a* rotates in the direction indicated by arrow 354*a*', and second roller 354*b* rotates in the direction indicated by arrow 354*b*'. During retraction, all movement is in the opposite direction.

The inferior end of rigid backing 352 is coupled to top sheet 355*a* and to bottom sheet 355*b*. Top sheet 355*a* is disposed around lead roller 356, which during expansion rotates in the counterclockwise direction indicated by arrow 356'. Bottom sheet 355*b* is disposed around trail roller 358, which during expansion rotates in the clockwise direction indicated by arrow 358'. The extension of top sheet 355*a* and bottom sheet 355*b* is similar to the embodiments previously described.

In a fully extended position, rigid backing 352 is positioned below top sheet 355*a* and provides a more solid support for the patient, if such a support is needed, for example when backboards are used for transporting patients.

Optional infinity belt 361 is disposed around wheel 360*a* and wheel 360*b* to tie wheels 360*a*, 360*b* together, so that they rotate in synchronization. During actuation of apparatus 350, infinity belt 351 facilitates the substantially frictionless rotation of wheels or rollers 356, 358, thus permitting top sheet 355*a* and bottom sheet 355*b* to extend relatively easily along the extent of apparatus 350 under the patient without pinching the patient or forcing the patient to move voluntarily.

Apparatus 350 further includes wheel/sprocket 362, chain/belt 364, wheel/roller 366 (which rotates in the direction indicated by arrow 366' during extension), handle 367 that is capable of actuating wheel/sprocket 366, and spring 368. The structure and mechanism of this chain/belt and spring assembly is substantially similar to that seen in FIGS. 6A-6C and 7B.

Figure 9A:
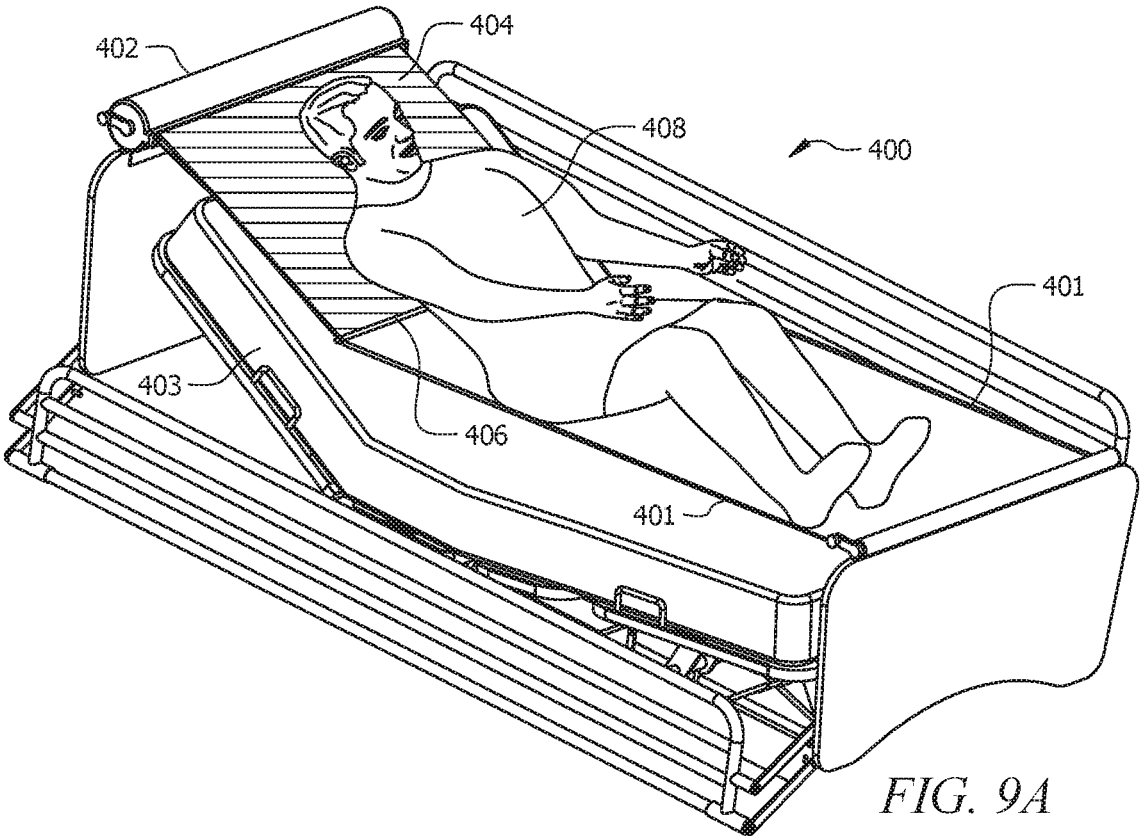
FIG. 9A depicts an embodiment of the current invention for use with a patient in a semi-Fowler or Fowler position, where the support mechanism is extending.
Figure 9B:
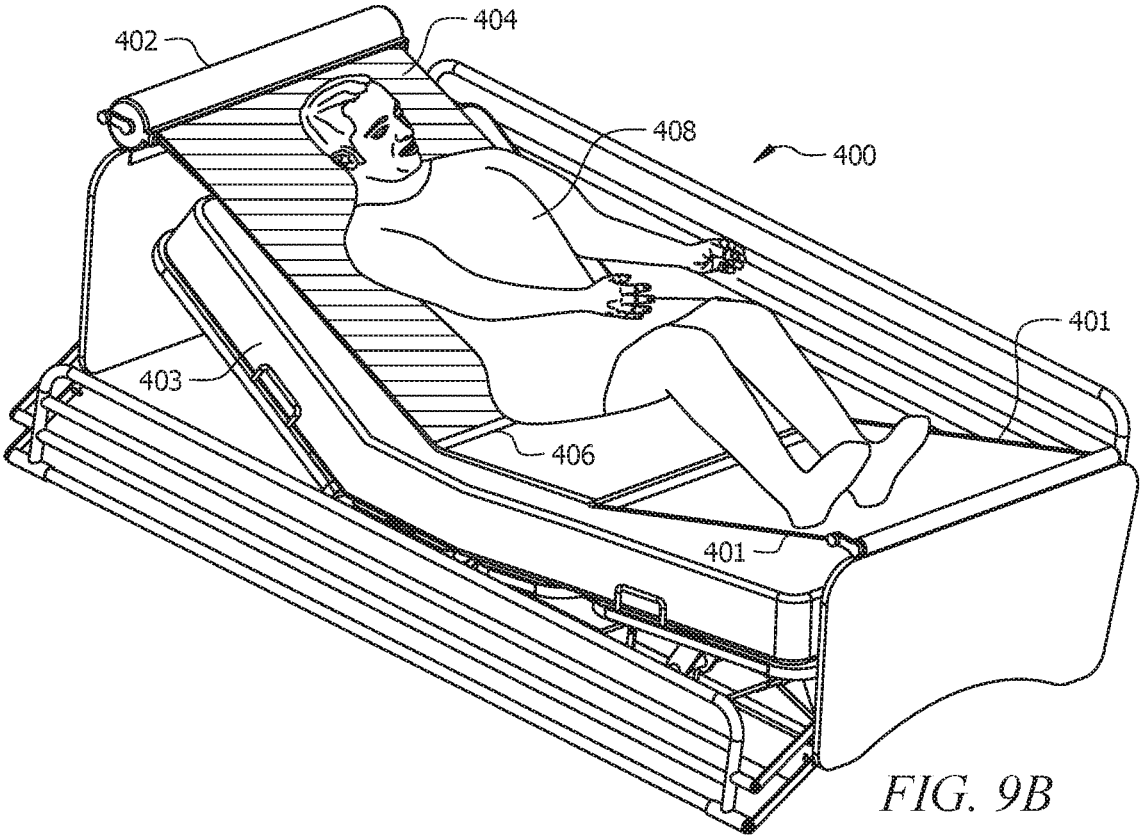
FIG. 9B depicts the embodiment of FIG. 9B, where the support mechanism has continued to extend.

Low Fowler's Semi-Fowler's or Fowler's Position (FIGS. 9A-9B)

FIGS. 9A-9B depict use of a support apparatus, generally denoted by reference numeral 400, on top of hospital bed 403, where patient 408 is in a low Fowler, semi-Fowler or Fowler's position (i.e., body is angled about 15°-60° and not directly supine). Apparatus 400 includes main frame 402, superior housing 402, and sheet 404 that is contained within superior housing 402 prior to extension. Sheet 404 (and the support mechanism generally) has lead edge 406 that extends underneath patient 408, such that in full extension, patient 408 can be lifted off of bed 403 and transported to another location.

Though not specifically seen in these figures, it can be understood by one of ordinary skill in the art that apparatus 400 has a substantially similar mechanism to the various embodiments previously described, specifically with regards to the wheels, rollers, chains/belts, etc. Main frame 401 being bent or flexible here allows sheet 404 to extend along main frame 401 to support patient 408 during transport in semi-Fowler or Fowler's position, as is needed for patient 408.

Figure 10B:
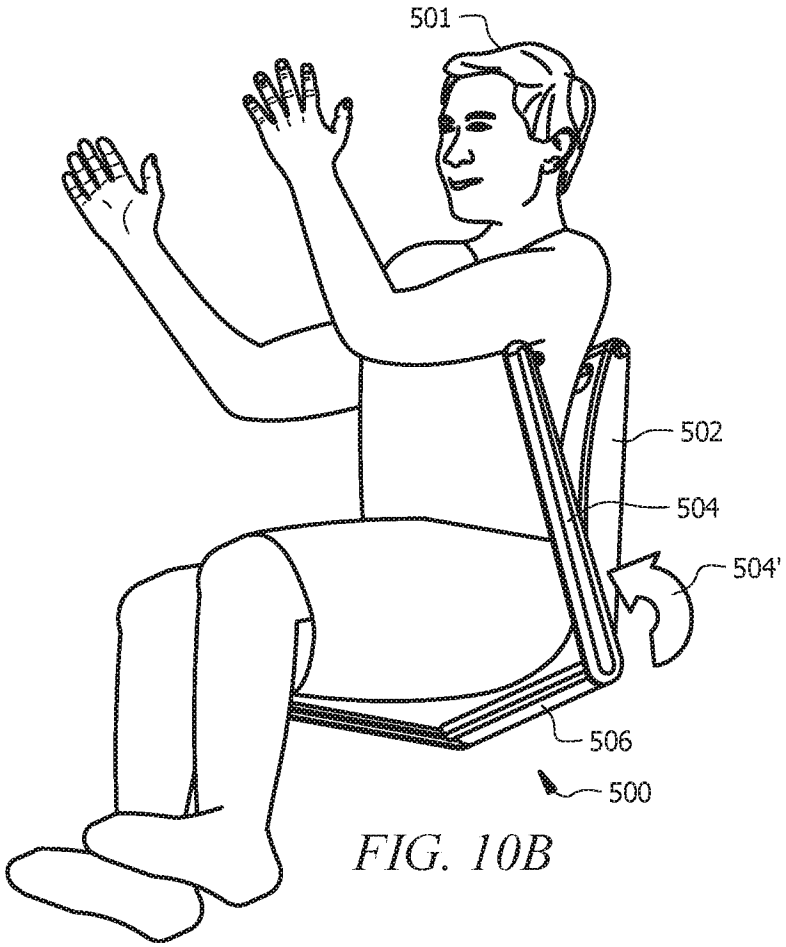
FIG. 10B depicts the embodiment of FIG. 10A with the embodiment inserted behind the patient's back and during rotation of the main frame arms.
Figure 10A:
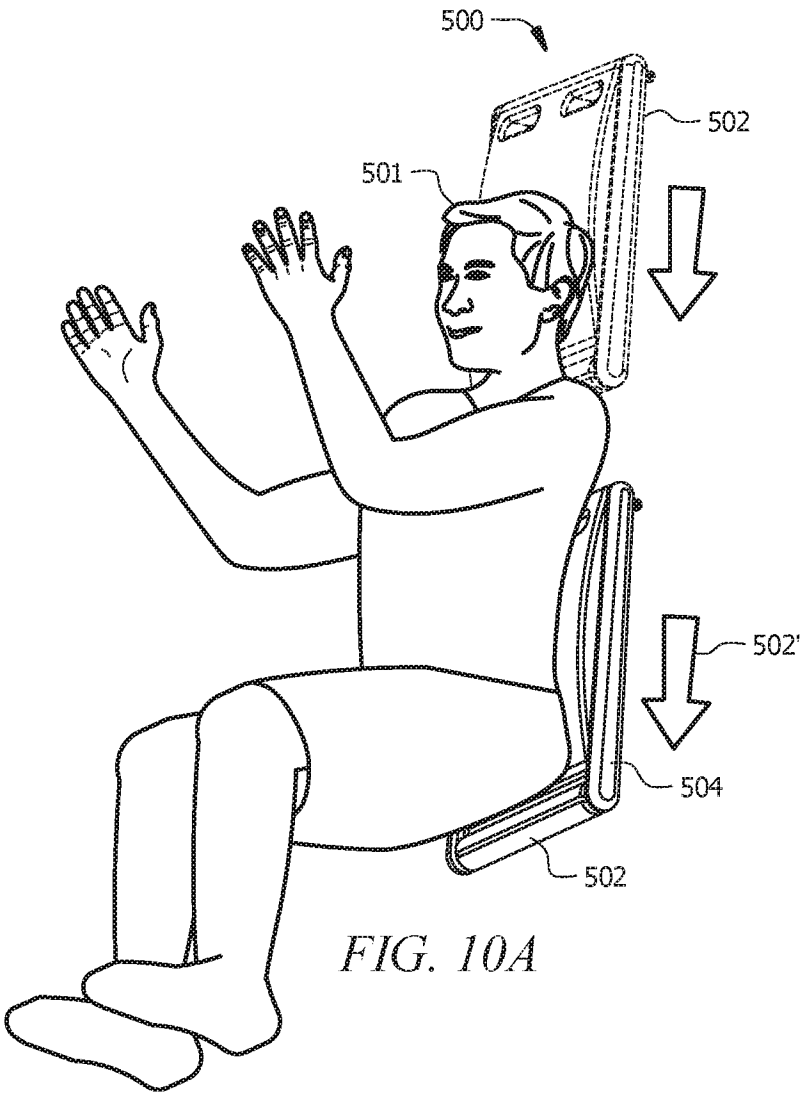
FIG. 10A depicts an embodiment of the current invention for use with a patient in a high Fowler position, where the embodiment is in an initial position just prior to insertion behind the patient's back.
Figure 10D:
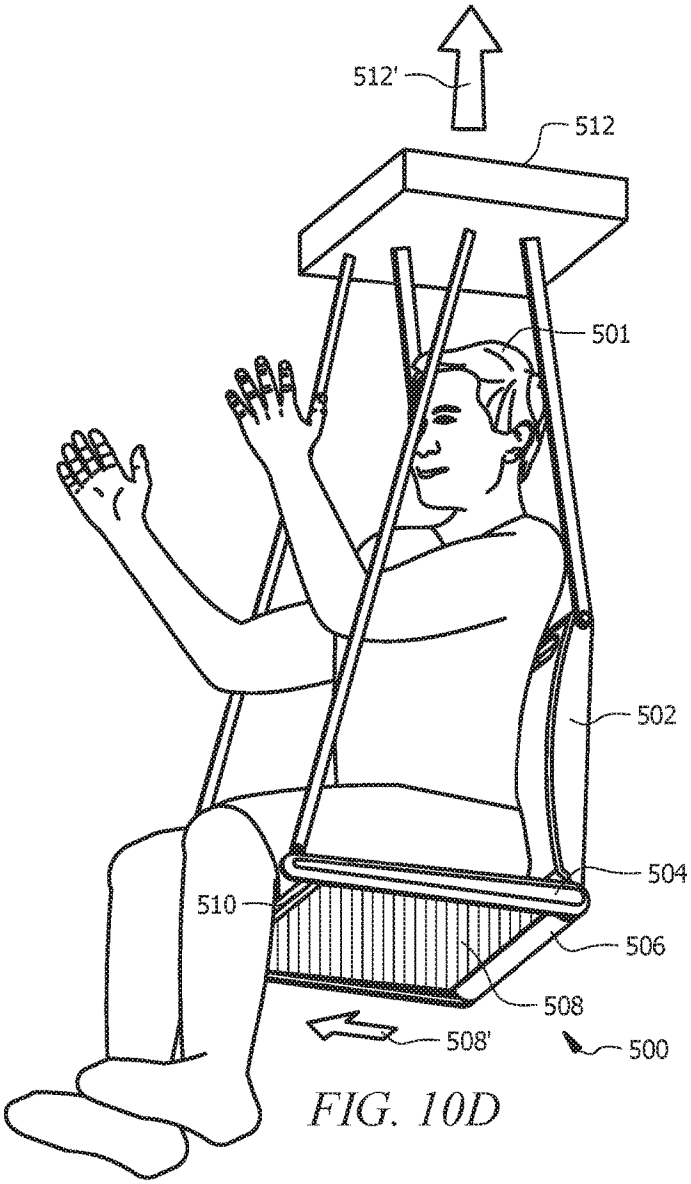
FIG. 10D depicts the embodiment of FIG. 10C with the support sheet fully extended beneath the patient's legs.
Figure 10C:
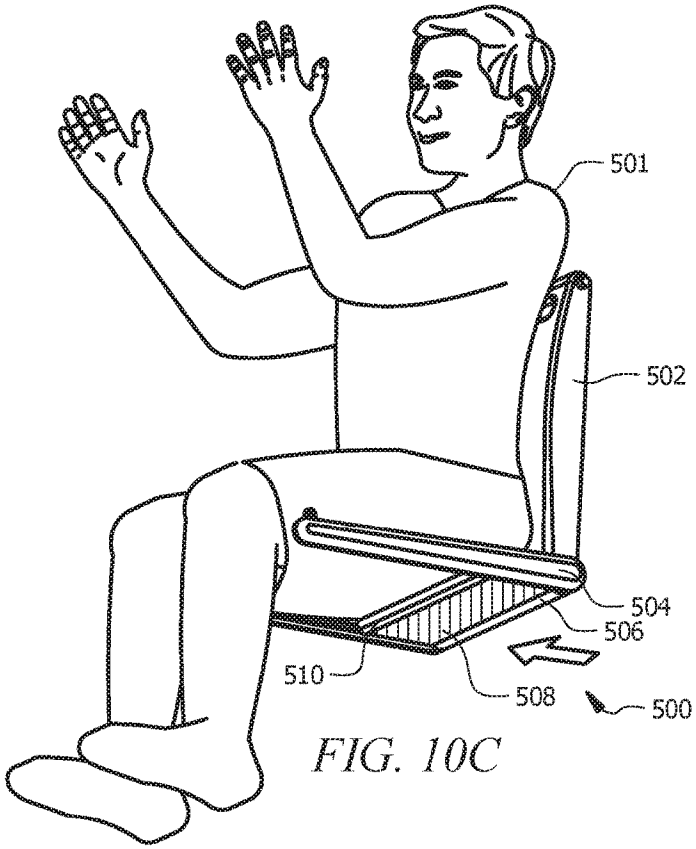
FIG. 10C depicts the embodiment of FIG. 10B with the main frame arms rotated ninety degrees (90°) relative to the remainder of the main frame and during extension of the support sheet beneath the patient's legs.

High Fowler's Position (FIGS. 10A-10C)

FIGS. 10A-10D depict use of a support apparatus, generally denoted by reference numeral 500, with patient 501 in a high Fowler's position (i.e., body is angled about 60°-90°. Apparatus 500 comprises back support 502, a main frame including arms 504, housing 506, and sheet 508 with leading edge 510. The seat or surface on which patient 501 is positioned is absent from these figures for the sake of clarity.

Back support 502 is inserted behind the back of patient 501 in the downward direction indicated by arrow 502'. When back support 502, and in particular housing 506 is aligned with the legs of patient 501 (see FIG. 10A), arms 504 are rotated outward in the direction indicated by arrow 504' (see FIG. 10B) until arms 504 are substantially perpendicular to the remainder of back support 502 and are substantially parallel to the legs of patient 501 (see FIG. 10C). Once in this position, sheet 508 and leading edge 510 begin to extend away from housing 506 in the direction indicated by arrow 508' (see FIG. 10C) until sheet 508 is sufficiently extended along arms 504 to support the weight of patient 501. Thus, any suitable lifting apparatus 512 can be coupled to apparatus 500 in order to lift patient 501 in the direction indicated by arrow 512' and transport patient accordingly (see FIG. 10D).

Though not specifically seen in these figures, it can be understood by one of ordinary skill in the art that apparatus 500 has a substantially similar mechanism to the various embodiments previously described, specifically with regards to the wheels, rollers, chains/belts, etc. The support mechanism would simply be disposed across arms 504 with housing 506 being the "superior housing" described in the previous embodiments, and the support mechanism extending therefrom.

Variations

It is contemplated herein that the current invention can be made and used with any combination of the embodiments and examples described herein, and any components thereof. For example, various configurations of pulleys, sprockets, and gears were described as being contained within the superior housing of the main frame. Similarly, various configurations of chains, belts, and springs were described herein, along with optional additions of infinity loops, depending on the other components used in that particular apparatus. Various combinations of these components are contemplated herein.

For example, the embodiment of FIGS. 6A-6C depict the sheets wrapped around a single wheel in the superior housing, along with the chain/belt wrapped around a wheel/sprocket on the lead roller with a fixed connection on the inferior housing, thus also using an infinity loops between the lead and trail rollers. However, it can be understood that the components in the superior housing can be replaced by the mechanism of FIG. 3A, FIG. 7A, FIG. 7B, or FIG. 8, depending on what is needed. Typically but optionally, if there is more than one unmeshed wheel in the superior housing, an infinity belt is used around the wheels.

It can also be understood that that chain/belt mechanism can be replaced with the chain/belt mechanism of FIG. 3A or FIG. 7B. Typically but optionally, when the chain/belt has a fixed connection on the inferior housing, an infinity belt is used around the lead and trail rollers.

As such, the method of driving the lead and trail rollers and the corresponding sheets can differ, as contemplated by the current invention, but the ultimate result is the uncoiling/coiling of the sheets, leading to extension/retraction as needed. Thus, the superior housing should have at least one wheel (e.g., gear, pulley, sprocket) or roller therein around which the sheets coil and uncoil. The sheets typically each have a fixed connection to the housing that contains them in the fully retracted position. During extension, the lead roller typically rotates in a counterclockwise direction, and the trail roller rotates in an opposing clockwise direction, and vice versa.

Additionally, the method of driving the chain/belt mechanism can differ, as contemplated by the current invention, but the ultimate result is the lead and trail rollers being directed toward the inferior housing during extension. Thus, the inferior housing should have at least one wheel (e.g., gear, pulley, sprocket) or roller therein around which the chain/belts is disposed.

The crux of the current invention is the double roller assembly including the lead roller and trail roller being neither vertically nor horizontally aligned. The upper roller should have a top sheet disposed therearound, and the lower roller should have a bottom sheet disposed therearound. As noted, these sheets each have an end with a fixed connection in or on its corresponding retracted-position housing, and an opposite end leading into said housing around at least one wheel or roller contained therein. This provides for extension of the sheets under the patient with nearly no friction and with no shear at all. The chain/belt mechanism that is affixed to the double roller assembly or disposed around one of the rollers can also facilitate the frictionless benefit of the current invention by urging extension of the double roller assembly under the patient.

Glossary of Claim Terms

Extended position: This term is used herein to refer to a state of the support apparatus with the support mechanism and sheets filling the open space within the apparatus' main frame.

Flexible interior layer: This term is used herein to refer to a pliable material that is coupled to the sheets between the top sheet and the bottom sheet. It can be formed of the same or different material as the sheets.

Inferior end: This term is used herein to refer to an end of an apparatus that is proximal to where the feet of an individual being transported would be positioned when using the apparatus (in other words, distal to where the head of the individual being transported would be positioned).

Infinity belt: This term is used herein to refer to a band or line that facilitates synchronous rotation of two gears, rollers, sprockets, or pulleys at a controlled rate.

Retracted position: This term is used herein to refer to a state of the support apparatus being withdrawn with an open space within the apparatus' main frame.

Rigid backing: This term is used herein to refer to a relatively inflexible support that, when fully extended, is capable of supporting the weight of an object or individual being lifted/transported.

Roller: This term is used herein to refer to a rotating cylindrical device that is capable of supporting the coiling, rotation, and/or movement of flexible structures, such as sheets, chains, belts, etc.

Sheet: This term is used herein to refer to a flat layer of fabric, canvas, rubber, or other suitable malleable material that is capable of supporting an object or individual to be lifted and transported.

Stabilizer: This term is used herein to refer to a structural component, such as a bracket or brace, that couples the lead and trail rollers together in a manner that prohibits one roller from moving substantially without the other.

Substantially coiled: This term is used herein to refer to a flexible material being looped or wound around a wheel or roller in the retracted position. The term "substantially" is used herein because a small portion of the flexible material may not be wound around the wheel or roller even in the fully retracted position. FIG. 6A depicts this idea, specifically that a majority of the flexible material is coiled around the wheel or roller in the retracted position but a small portion remains coiled.

Substantially uncoiled: This term is used herein to refer to a flexible material unwinding from a wheel or roller and extending away from the wheel or roller into the open space. The term "substantially" is used herein because a small portion of the flexible material may still be wound around the wheel or roller even in the fully extended position. FIG. 6C depicts this idea, specifically that a majority of the flexible material is uncoiled from the wheel or roller and has extended into the open space in the extended position but a small portion remains coiled around the wheel or roller.

Superior end: This term is used herein to refer to an end of an apparatus that is proximal to where the head of an individual being transported would be positioned when using the apparatus.

Support apparatus: This term is used herein to refer to a device that is used to bear the weight of an object or individual thereabove for use in transporting said object or individual. An example of such a support apparatus is a stretcher used to transport patients for medical purposes.

Vertically and horizontally displaced: This term is used herein to refer to relative positioning between the lead roller and trail roller, such that they are not directly aligned horizontally or vertically. In the figures, they are approximately diagonally aligned with the lead roller positioned "ahead" of the trail roller (during extension of the sheets). It is contemplated herein, however, that either roller can be "above" the other.

Wheel: This term is used herein to refer to a structural component that is capable of supporting the coiling, rotation, and/or movement of flexible structures, such as sheets, chains, belts, etc. Examples of such a wheel include, but are not limited to, gears, sprockets, and pulleys.

The advantages set forth above, and those made apparent from the foregoing description, are efficiently attained. Since certain changes may be made in the above construction without departing from the scope of the invention, it is intended that all matters contained in the foregoing description or shown in the accompanying drawings shall be interpreted as illustrative and not in a limiting sense.

It is also to be understood that the following claims are intended to cover all of the generic and specific features of the invention herein described, and all statements of the scope of the invention that, as a matter of language, might be said to fall therebetween.

What is claimed is:

1. A support apparatus having a retracted position and an extended position, comprising:

a first at least one wheel or roller positioned at a first end of said support apparatus;

an opposing wheel or roller positioned at a second end of said support apparatus;

a main frame extending along a length of said support apparatus between said first at least one wheel or roller and said opposing wheel or roller, forming an open space therewithin;

a flexible first sheet substantially coiled around said first at least one wheel or roller in said retracted position, said first sheet substantially uncoiled from said first at least one wheel or roller in said extended position;

a flexible second sheet substantially coiled around a wheel or roller selected from said first at least one wheel or roller in said retracted position, said second sheet substantially uncoiled from said wheel or roller selected from said first at least one wheel or roller in said extended position;

a double roller assembly having ends disposed within said main frame during transition to and from said extended position, said double roller assembly including a lead roller and a trail roller that are vertically and horizontally displaced from one another, said lead roller and said trail roller directly or indirectly coupled to one another such that said lead roller and said trail roller jointly and mutually travel along said main frame during transitions between said retracted position and said extended position, wherein said first sheet is disposed around said lead roller and said second sheet is disposed around said trail roller; and a chain or belt assembly including a chain or belt disposed around said opposing wheel or roller, said chain or belt assembly having a first end affixed to said double roller assembly, wherein said support apparatus transitions from said retracted position to said extended position by said first at least one wheel or roller rotating in a manner to extend said first and second sheets into and along said open space, and wherein said support apparatus transitions from said extended position to said retracted position by said first at least one wheel or roller rotating in a manner to retract said first and second sheets out of said open space and toward said first at least one wheel or roller.

2. A support apparatus as in claim 1, further comprising:

said double roller assembly further including a stabilizer on each end of said double roller assembly, said stabilizer coupling said lead roller and said trail roller together.

3. A support apparatus as in claim 1, further comprising:

said lead roller being disposed above said trail roller, said first sheet being a top sheet that extends underneath an object or individual to be lifted and supports a weight of said object or individual, and said trail roller being disposed under said lead roller, said second sheet being a bottom sheet that extends along a surface on which said support apparatus is positioned.

4. A support apparatus as in claim 1, further comprising:

said second sheet substantially coiled around said first at least one wheel or roller in said retracted position, said second sheet substantially uncoiled from said first at least one wheel or roller in said extended position.

5. A support apparatus as in claim 4, further comprising:

said first and second sheets having ends opposite their affixed ends that are affixed to a flexible interior layer, said flexible interior layer coiled around said first at least one wheel or roller in said retracted position, said flexible interior layer at least partially uncoiled from said first at least one wheel or roller in said extended position.

6. A support apparatus as in claim 1, further comprising:

said second sheet substantially coiled around a second wheel or roller selected from said first at least one wheel or roller in said retracted position, said second sheet substantially uncoiled from said second wheel or roller in said extended position, said first at least one wheel or roller being disposed on or through a driving gear and said second wheel or roller being disposed on or through a driven gear, said driving gear and said driven gear being meshed, such that rotation of said driving gear drives rotation of said driven gear, thus driving extension and retraction of said first and second sheets.

7. A support apparatus as in claim 1, further comprising:

said second sheet substantially coiled around a second wheel or roller selected from said first at least one wheel or roller in said retracted position, said second sheet substantially uncoiled from said second wheel or roller in said extended position, said first at least one wheel or roller including a driver pulley and said second wheel or roller including a driven pulley, said driver pulley and said driven pulley in communication with each other via an infinity belt, such that rotation of said driver pulley drives rotation of said driven pulley, thus driving extension and retraction of said first and second sheets.

8. A support apparatus as in claim 1, further comprising:

said first and second sheets having ends opposite their affixed ends that are affixed to a rigid backing, said rigid backing collapsed at an end of said support apparatus in said retracted position, said rigid backing extended along said open space and between said first and second sheets in said extended position.

9. A support apparatus as in claim 1, further comprising:

said main frame being angled or bent in a manner to permit positioning in a low Fowler's position, a semi-Fowler's position, a Fowler's position, or a combination thereof.

10. A support apparatus as in claim 1, further comprising:

a back support disposed in perpendicular relation to said main frame, thus permitting positioning in a high Fowler's position.

11. A support apparatus as in claim 1, further comprising:

a first housing assembly including a first housing containing said first at least one wheel or roller at said first end of said support apparatus; and a second housing assembly including a second housing containing said opposing wheel or roller at said second end of said support apparatus.

12. A support apparatus as in claim 11, further comprising:

said first sheet having an end affixed to said first housing assembly, and said second sheet also having an end affixed to said first housing assembly.

13. A support apparatus as in claim 1, further comprising:

said chain or belt further disposed around a wheel mounted on said first at least one wheel or roller, wherein both ends of said chain or belt are affixed to said double roller assembly.

14. A support apparatus as in claim 1, further comprising:

said chain or belt assembly further including a compression spring that has a resilient bias toward being compressed, said compression spring having an end that is coupled to said chain or belt and an opposite end that is coupled to said double roller assembly.

15. A support apparatus as in claim 14, wherein an opposite end of said chain or belt is affixed to said double roller assembly.

16. A support apparatus as in claim 14, further comprising:

said chain or belt further disposed around a wheel mounted on said lead roller, wherein an opposite end of said chain or belt is affixed at said second end of said support apparatus;

an infinity belt disposed between said lead roller and said trail roller.

17. A support apparatus as in claim 1, further wherein:

during transition from said retracted position to said extended position, said second wheel or roller rotates such that double roller assembly travels in a head-to-toe direction, and during transition from said extended position to said retracted position, said second wheel or roller rotates such that said double roller assembly travels in a toe-to-head direction.

18. A support apparatus as in claim 17, wherein:

during transition from said retracted position to said extended position, said first at least one wheel or roller rotates in a first direction, said lead roller rotates in an opposite direction to said first direction, and said trail roller rotates in said first direction, and during transition from said extended position to said retracted position, said first at least one wheel or roller rotates in a second direction, said lead roller rotates in an opposite direction to said second direction, and said trail roller rotates in said second direction.

19. A support apparatus as in claim 1, wherein said first end of said support apparatus is a superior end of said support apparatus, and said second end of said support apparatus is an inferior end of said support apparatus.

20. A support apparatus as in claim 1, wherein when an object or patient is positioned within said open space, said first at least one wheel or roller is rotated, said opposing wheel or roller is rotated, said chain or belt assembly pulls said double roller assembly, said lead and trail rollers rotate and travel along said main frame, thus extending said first and second sheets along said open space and underneath an object or individual until said extended position is achieved and said object or individual can be lifted and transported while being supported at least by said first and second sheets.

* * * * *